US008104644B2

(12) United States Patent
Py et al.

(10) Patent No.: US 8,104,644 B2
(45) **Date of Patent: *Jan. 31, 2012**

(54) ONE-WAY VALVE AND APPARATUS AND METHOD OF USING THE VALVE

(75) Inventors: Daniel Py, Larchmont, NY (US); Julian V. Chan, Spring Valley, NY (US); Benoit Adamo, Pelham, NY (US); Nathaniel Houle, Hebron, CT (US)

(73) Assignee: Medical Instill Technologies, Inc., New Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/901,422

(22) Filed: Oct. 8, 2010

(65) Prior Publication Data

US 2011/0024463 A1 Feb. 3, 2011

Related U.S. Application Data

(63) Continuation of application No. 11/650,102, filed on Jan. 5, 2007, now Pat. No. 7,810,677, which is a continuation-in-part of application No. 11/295,274, filed on Dec. 5, 2005, now Pat. No. 7,278,553.

(60) Provisional application No. 60/633,332, filed on Dec. 4, 2004, provisional application No. 60/644,130, filed on Jan. 14, 2005, provisional application No. 60/757,161, filed on Jan. 5, 2006.

(51) Int. Cl.
*B65D 37/00* (2006.01)

(52) U.S. Cl. ..... 222/207; 222/1; 222/105; 222/212; 222/213; 222/494; 222/632; 222/633

(58) Field of Classification Search ..... 222/207–214, 222/494–496, 631–633, 94, 105, 1; 137/853; 417/472, 479

See application file for complete search history.

(56) References Cited

U.S. PATENT DOCUMENTS 1,392,600 A 10/1921 Rose (Continued)

FOREIGN PATENT DOCUMENTS

CA 1123792 5/1982

(Continued)

OTHER PUBLICATIONS

International Search Report for International Application No. PCT/US05/44167, mailed Jun. 20, 2006.

(Continued)

*Primary Examiner* — Frederick C. Nicolas

(74) *Attorney, Agent, or Firm* — McCarter & English, LLP

(57) ABSTRACT

A flexible pouch and valve assembly is provided for aseptically storing a substance, dispensing multiple portions of the stored substance therefrom, and maintaining substance remaining in the pouch in an aseptic condition sealed with respect to ambient atmosphere. The flexible pouch and valve assembly are receivable within a relatively rigid housing, and are adapted to cooperate with a pump for pumping discrete portions of substance from the pouch and through the one-way valve to dispense the substance therefrom. The assembly comprises a flexible pouch defining therein a variable-volume storage chamber sealed with respect to the ambient atmosphere for aseptically storing therein multiple portions of the substance. A one-way valve of the assembly includes a valve body defining an axially-extending valve seat and at least one flow aperture extending through the valve body and/or the valve seat.

27 Claims, 20 Drawing Sheets

U.S. PATENT DOCUMENTS 2,014,881 A 9/1935 Carlstrom
2,317,270 A 4/1943 Harris
2,471,852 A 5/1949 Bau
2,715,980 A 8/1955 Frick
3,160,329 A 12/1964 Radic et al.
3,173,579 A 3/1965 Curie et al.
3,180,374 A 4/1965 Muller
3,211,340 A 10/1965 Zander et al.
3,220,611 A 11/1965 Zander et al.
3,231,149 A 1/1966 Yuza
3,499,582 A 3/1970 Berney
3,820,689 A 6/1974 Cocita
3,987,938 A 10/1976 Cooprider et al.
4,015,752 A 4/1977 Meuresch et al.
4,078,705 A 3/1978 Butcher
4,099,651 A 7/1978 Von Winckelmann
4,168,020 A 9/1979 Benson
4,216,236 A 8/1980 Mueller et al.
4,239,132 A 12/1980 Mueller et al.
4,249,675 A 2/1981 Nilson
4,256,242 A 3/1981 Christine
4,314,654 A 2/1982 Gaubert
4,349,133 A 9/1982 Christine
4,366,912 A 1/1983 Matukura et al.
4,401,239 A 8/1983 Thomassen
4,420,100 A 12/1983 Mueller
4,425,366 A 1/1984 Sozzi et al.
4,425,698 A 1/1984 Petrie
4,457,454 A 7/1984 Meshberg
4,520,948 A 6/1985 Hampel et al.
4,526,294 A 7/1985 Hirschmann et al.
4,561,571 A 12/1985 Chen
4,607,764 A 8/1986 Christine
4,660,737 A 4/1987 Green et al.
4,667,854 A 5/1987 McDermott et al.
4,776,495 A 10/1988 Vignot
4,823,990 A 4/1989 Roggenburg et al.
4,854,483 A 8/1989 Haggart
4,981,479 A 1/1991 Py
5,033,647 A 7/1991 Smith et al.
5,074,440 A 12/1991 Clements et al.
5,099,885 A 3/1992 Nilsson
5,100,027 A 3/1992 Gueret
5,108,007 A 4/1992 Smith et al.
5,145,083 A 9/1992 Takahashi
5,176,510 A 1/1993 Nilsson
5,178,300 A 1/1993 Haviv et al.
5,226,568 A 7/1993 Newton et al.
5,238,153 A 8/1993 Castillo et al.
5,267,986 A 12/1993 Py
5,271,513 A 12/1993 Crosner et al.
5,303,851 A 4/1994 Libit et al.
5,332,121 A 7/1994 Schmidt et al.
5,339,972 A 8/1994 Crosnier et al.
5,360,145 A 11/1994 Gueret
5,401,259 A 3/1995 Py
5,409,146 A 4/1995 Hazard et al.
5,429,254 A 7/1995 Christine
5,435,463 A 7/1995 Hodgson
5,452,826 A 9/1995 Stern
5,453,096 A 9/1995 Lataix
5,454,488 A 10/1995 Geier
5,464,125 A 11/1995 Daansen
5,492,252 A 2/1996 Gueret
RE35,187 E 3/1996 Gortz
5,499,758 A 3/1996 McCann et al.
5,505,341 A 4/1996 Gueret
5,617,976 A 4/1997 Gueret
5,641,004 A 6/1997 Py
5,664,705 A 9/1997 Stolper
5,685,869 A 11/1997 Py
5,687,882 A 11/1997 Mueller
5,697,532 A 12/1997 Wilde et al.
5,772,079 A 6/1998 Gueret
5,803,311 A 9/1998 Fuchs
5,836,484 A 11/1998 Gerber
5,842,321 A 12/1998 Jones
5,857,595 A 1/1999 Nilson
5,875,931 A 3/1999 Py
5,931,386 A 8/1999 Jouillat
5,944,702 A 8/1999 Py
5,971,224 A 10/1999 Garibaldi
RE36,410 E 11/1999 Meshberg
5,996,845 A 12/1999 Chen
6,003,733 A 12/1999 Wheeler
6,024,252 A 2/2000 Clyde
6,033,384 A 3/2000 Py
6,062,430 A 5/2000 Fuchs
6,092,695 A 7/2000 Loeffler
6,149,957 A 11/2000 Mandralis et al.
6,170,715 B1 1/2001 Evans
6,182,698 B1 2/2001 Barak
6,216,916 B1 4/2001 Maddox et al.
6,254,579 B1 7/2001 Cogger et al.
6,325,253 B1 12/2001 Robinson
6,386,395 B1 5/2002 Lunghetti
6,450,994 B1 9/2002 Boyles et al.
6,455,093 B1 9/2002 Furrer et al.
6,471,095 B1 10/2002 Cann
6,491,189 B2 12/2002 Friedman
6,524,287 B1 2/2003 Cogger
6,547,108 B2 4/2003 Johanson
6,561,383 B1 5/2003 Reddy et al.
6,592,918 B2 7/2003 Kaeser
6,592,922 B2 7/2003 Furrer et al.
6,662,977 B2 12/2003 Gerber et al.
6,695,173 B1 2/2004 Fontana
6,698,628 B2 3/2004 Mascitelli
6,742,680 B2 6/2004 Friedman
6,755,327 B1 6/2004 Hazard et al.
D493,366 S 7/2004 Rackwitz
6,758,620 B1 7/2004 Harrold
6,761,286 B2 7/2004 Py et al.
6,769,627 B2 8/2004 Carhuff et al.
6,802,436 B2 10/2004 Drennow et al.
6,883,222 B2 4/2005 Landau
6,892,906 B2 5/2005 Py et al.
6,971,553 B2 12/2005 Brennan et al.
7,011,233 B2 3/2006 Drennow
7,278,553 B2 10/2007 Py
7,322,491 B2 1/2008 Py et al.
7,806,301 B1 10/2010 Ciavarella et al.
7,810,677 B2 * 10/2010 Py et al. ..... 222/207
7,850,051 B2 * 12/2010 Py et al. ..... 222/207
2001/0027827 A1 10/2001 Jeannin et al.
2002/0050301 A1 5/2002 Jeannin et al.
2002/0074362 A1 6/2002 Py et al.
2002/0121527 A1 9/2002 Good
2002/0124907 A1 9/2002 Crossdale et al.
2003/0012858 A1 1/2003 Furrer et al.
2003/0082070 A1 5/2003 Liberto et al.
2004/0011820 A1 1/2004 Abergel et al.
2004/0118291 A1 6/2004 Carhuff et al.
2004/0194811 A1 10/2004 Carhuff et al.
2005/0029307 A1 2/2005 Py et al.
2005/0072480 A1 4/2005 Brandes
2005/0089358 A1 4/2005 Py et al.
2005/0165368 A1 7/2005 Py et al.
2005/0260090 A1 11/2005 Stark et al.
2006/0169722 A1 8/2006 Py et al.
2006/0186139 A1 8/2006 Laidler et al.
2008/0149191 A1 * 6/2008 Py et al. ..... 137/487.5

FOREIGN PATENT DOCUMENTS

CN 2436454 6/2001
CN 1489542 A 4/2004
EP 0172711 2/1986
EP 0616141 9/1994
EP 0649795 4/1995
EP 0733559 9/1996
EP 0743263 11/1996
EP 1546021 2/2004
EP 0802827 10/2007
FR 2709733 3/1995
GB 190300710 A 10/1903
JP 52-91345 12/1950
JP S59-10986 4/1984

| | | |
|---|---|---|
| JP | H2-21078 | 6/1990 |
| JP | 06-239379 | 8/1994 |
| JP | 07-125799 | 5/1995 |
| JP | 10-156269 | 6/1998 |
| JP | 2002-347812 | 12/2002 |
| JP | 05-016950 | 1/2003 |
| JP | 2005-535530 | 11/2005 |
| WO | WO 93/16955 | 9/1993 |
| WO | WO 95/34381 | 12/1995 |
| WO | WO 99/32185 | 1/1999 |
| WO | WO 99/41158 | 8/1999 |
| WO | WO 00/29192 | 5/2000 |
| WO | WO 02/40122 | 5/2002 |
| WO | WO 03/033363 | 4/2003 |

OTHER PUBLICATIONS

International Search Report and Written Opinion of the International Searching Authority for International Application No. PCT/US07/00419, mailed Jan. 8, 2008.

* cited by examiner

ONE-WAY VALVE AND APPARATUS AND METHOD OF USING THE VALVE

CROSS REFERENCE TO RELATED PATENT APPLICATIONS

This patent application is a continuation of Ser. No. 11/650,102 U.S. Pat. No. 7,810,677 filed Jan. 5, 2007 entitled "One-Way Valve and Apparatus and Method of Using the Valve," which is a continuation-in-part of Ser. No. 11/295,274 U.S. Pat. No. 7,278,553, filed Dec. 5, 2005, entitled "One-Way Valve and Apparatus Using the Valve", which claims priority to U.S. Provisional Patent Application Ser. No. 60/633,332, filed Dec. 4, 2004 and U.S. Provisional Patent Application Ser. No. 60/644,130, filed Jan. 14, 2005, both of which are entitled "One-Way Valve, Apparatus and Method of Using the Valve." This patent also claims priority to U.S. Provisional Patent Application Ser. No. 60/757,161, filed Jan. 5, 2006, entitled "One-Way Valve and Apparatus and Method of Using the Valve." Each of the foregoing patent applications is hereby incorporated by reference in its entirety as part of the present disclosure.

FIELD OF THE INVENTION

The present invention relates to one-way valves and apparatus and methods using one-way valves, and more particularly, to one-way valves defining valve seats and flexible valve covers overlying the valve seats, and to dispensers and packaging incorporating such valves and methods of using such valves.

BACKGROUND INFORMATION

Aseptic packaging is widely used to prolong the shelf life of food and drink products. With conventional aseptic packaging, the product is filled and sealed in the package under sterile or bacteria-free conditions. In order to maximize shelf life prior to opening, the product and the packaging material may be sterilized prior to filling, and the filling of the product in the packaging is performed under conditions that prevent re-contamination of the product. One such prior art dispenser system that employs an aseptically filled package is shown in U.S. Pat. No. 6,024,242. The package includes a pouch that holds the food or beverage, and a flexible, open-ended tube connected to the pouch for dispensing the product therethrough. A pinch valve is used in the dispenser to pinch the open end of the tube and thereby close the tube from the ambient atmosphere. In order to dispense product, the pinch valve is released from the tube, and the product is in turn allowed to flow from the pouch and through the open end of the tube.

One of the drawbacks of this type of prior art dispenser and packaging is that during installation of the pouch and tube assembly into the dispenser, and during dispensing, there is a risk that bacteria or other unwanted substances can enter into the open ended tube and contaminate the product. If the product is a non-acid product, such as a milk-based product, it must be maintained under refrigeration to ensure the life of the product.

It is an object of the present invention to overcome one or more of the above-described drawbacks and/or disadvantages of the prior art.

SUMMARY OF THE INVENTION

In accordance with a first aspect, the present invention is directed to a flexible pouch and valve assembly for aseptically storing a substance, dispensing multiple portions of the stored substance therefrom, and maintaining substance remaining in the pouch in an aseptic condition sealed with respect to ambient atmosphere. The flexible pouch and valve assembly are receivable within a relatively rigid housing, and are adapted to cooperate with a pump for pumping discrete portions of substance from the pouch and through the one-way valve to dispense the substance therefrom. The assembly comprises a flexible pouch defining therein a variable-volume storage chamber sealed with respect to the ambient atmosphere for aseptically storing therein multiple portions of the substance. A one-way valve of the assembly includes a valve body defining an axially-extending valve seat, and at least one flow aperture extending through at least one of the valve body and valve seat. A valve cover is mounted on the valve body, and includes an axially-extending portion formed of an elastic material overlying the valve seat and covering a substantial axially-extending portion thereof. The valve portion defines a predetermined radial thickness and forms an interference fit with the valve seat, the valve portion and the valve seat define an axially-extending seam therebetween forming a normally closed, axially-extending valve opening, and the valve portion is movable radially between (i) a normally closed position with the valve portion engaging the valve seat, and (ii) an open position with at least a segment of the valve portion spaced radially away from the valve seat to connect the valve opening in fluid communication with the at least one flow aperture and thereby allow the passage of substance from the variable-volume storage chamber through the valve opening. In the normally closed and open positions, the one-way valve maintains substance remaining in the variable-volume storage chamber in an aseptic condition and sealed with respect to the ambient atmosphere.

In some embodiments of the present invention, the flexible pouch defines a sealed, empty, aseptic storage chamber adapted to receive therein a substance to be stored and dispensed therefrom. In some embodiments of the present invention, the flexible pouch is aseptically filled with a substance that is at least one of a food and beverage. In one such embodiment, the pouch is formed of a plastic laminate including an oxygen/water barrier and an approved food contact layer. In one such embodiment, the substance is selected from the group including a milk-based product, milk, evaporated milk, condensed milk, cream, half-and-half, baby formula, growing up milk, yogurt, soup, ice cream, juice, syrup, coffee, condiments, ketchup, mustard, mayonnaise, and coffee aroma.

Some embodiments of the present invention further comprise a flexible tube coupled in fluid communication between the pouch and one-way valve. In one such embodiment, the flexible tube is connected to the flexible pouch and one-way valve by at least one of (i) a fitting mounted on at least one of the flexible pouch and one-way valve that frictionally engages a respective end of the tube to form a hermetic seal therebetween, (ii) a heat seal, (iii) a weld, and (iv) an adhesive.

In some embodiments of the present invention, the assembly further includes an elastic actuator coupled in fluid communication between the pouch and one-way valve that is manually movable to pump substance from the variable-volume storage chamber through the one-way valve. In one such embodiment, the elastic actuator is approximately dome-shaped. Some such embodiments further comprise a manually-engageable operator that is manually engageable to depress the elastic actuator and, in turn, dispense substance from the variable-volume storage chamber through the one-way valve. In some such embodiments, the manually-engageable operator is a lever.

In some embodiments of the present invention, the assembly further comprises a relatively rigid container receiving therein the flexible pouch. In some such embodiments, the relatively rigid container is made of either cardboard or plastic.

In accordance with another aspect, the present invention is directed to the assembly in combination with a dispenser. The dispenser comprises a relatively rigid container receiving therein the flexible pouch, and a surface for supporting and positioning the one-way valve for dispensing substances therefrom and into another container. In one such embodiment, the dispenser further includes a pump operatively coupled between the variable-volume storage chamber and the one-way valve, and a control unit electrically coupled to the pump to control operation of the pump and, in turn, control dispensing of substance within the variable-volume storage chamber, through the one-way valve, and into the other container. In one such embodiment, the dispenser includes at least one pouch, and the at least one pouch includes at least one of coffee, coffee concentrate, milk, milk-based product, half-and-half, and creamer. In one such embodiment, the dispenser further includes at least one pouch containing coffee aroma.

In accordance with another aspect, the present invention is directed to a flexible pouch and valve assembly for aseptically storing a substance, dispensing multiple portions of the stored substance therefrom, and maintaining substance remaining in the pouch in an aseptic condition sealed with respect to ambient atmosphere. The flexible pouch and valve assembly are receivable within a relatively rigid housing and adapted to cooperate with a pump for pumping discrete portions of substance from the pouch and through the one-way valve to dispense the substance therefrom. The assembly comprises first means defining therein a flexible, variable-volume storage chamber sealed with respect to the ambient atmosphere for aseptically storing therein multiple portions of the substance. The assembly further comprises second means for allowing substance from the variable-volume storage chamber to be dispensed therethrough, and for maintaining the substance remaining in the variable-volume storage chamber in an aseptic condition and sealed with respect to the ambient atmosphere during and after dispensing of substance therethrough. The second means includes third means for forming an axially-extending valve seat and at least one flow aperture. The second means also includes fourth means mounted on the third means and defining an elastic, axially-extending portion overlying the third means and covering a substantial axially-extending portion thereof, defining a predetermined radial thickness and forming an interference fit with the third means, and defining an axially-extending seam between the third and fourth means, for forming a normally closed, axially-extending valve opening, and for moving radially between (i) a normally closed position with the fourth means engaging the third means, and (ii) an open position with at least a segment of the fourth means spaced radially away from the third means, to connect the valve opening in fluid communication with the at least one flow aperture and thereby allow the passage of substance from the variable-volume storage chamber through the valve opening. The fourth means cooperates with the third means to maintain the substance remaining in the variable-volume storage chamber in an aseptic condition and sealed with respect to the ambient atmosphere in the normally closed and open positions.

In one embodiment of the present invention, the variable-volume storage chamber contains a milk-based product, and the second means is for substantially preventing micro-organisms from entering into the variable-volume storage chamber and for permitting the milk-based product to be stored and dispensed without refrigeration.

In one embodiment of the present invention, the first means is a flexible pouch, the second means is one-way valve, the third means is a valve body, and the fourth means is a flexible valve cover.

In accordance with another aspect, the present invention is directed to a method for storing fluid and dispensing multiple portions of the stored fluid therefrom, comprising the following steps:

(1) providing a storage chamber and storing therein multiple portions of the fluid in an aseptic condition;

(2) providing a one-way valve assembly including (i) a valve body defining a valve seat and a flow aperture extending through at least one of the valve body and valve seat; and (ii) a valve cover formed of an elastic material and including a valve portion overlying the valve seat, wherein the valve portion defines a predetermined radial thickness and forms an interference fit with the valve seat, the valve portion and the valve seat define a normally closed, axially-extending valve opening therebetween, and the valve portion is movable relative to the valve seat between a normally closed position with the valve portion engaging the valve seat, and an open position with at least a segment of the valve portion spaced away from the valve seat to connect the valve opening in fluid communication with the flow aperture and thereby allow the passage of fluid from the flow aperture through the valve opening; and (3) maintaining the fluid in the storage chamber in an aseptic condition during the shelf life and dispensing of fluid through the one-way valve assembly.

In some embodiments of the present invention, the method further comprises the step of providing a hermetically sealed variable-volume storage chamber and storing therein multiple portions of the fluid in a substantially airless condition, and maintaining the fluid in the variable-volume storage chamber substantially airless during the shelf life and dispensing of fluid through the one-way valve assembly. In some embodiments of the present invention, the method further comprises the step of providing a pump coupled between the storage chamber and the one-way valve assembly and pumping with the pump discrete portions of fluid from the storage chamber, through the flow aperture, and in turn through the valve opening.

In some embodiments of the present invention, the method further comprises the steps of: (i) providing at least one of the storage chamber, pump and one-way valve assembly with a needle penetrable and thermally resealable portion; and (ii) filling the storage chamber with the fluid by penetrating the needle penetrable and thermally resealable portion with a needle, introducing the fluid through the needle and into the storage chamber, withdrawing the needle, and hermetically resealing a resulting needle hole in the needle penetrable and thermally resealable portion by applying thermal energy thereto.

In one such embodiment, the method further comprises the step of forming a substantially transparent needle penetrable and thermally resealable portion by combining (i) a styrene block copolymer; (ii) an olefin; (iii) a pigment added in an amount of less than about 150 ppm; and (iv) a lubricant. In one such embodiment, the pigment is a substantially transparent near infrared absorber.

In some embodiments of the present invention, the variable-volume storage chamber is defined by (i) a flexible pouch, including, for example, the interior of a flexible pouch, or the space between a flexible pouch and a relatively rigid vessel or like body, or (ii) a rigid body including, for example, a piston slidably received within the body, and forming a fluid-tight seal between a peripheral portion of the piston and the body, and defining the variable-volume storage chamber between the piston and the flow aperture of the one-way valve assembly. In an alternative embodiment, a vessel or other body defines therein the storage chamber and includes a filter coupled in fluid communication between the storage chamber and ambient atmosphere for filtering air or other gas flowing into the chamber upon dispensing fluid therefrom to sterilize the air or other gas flowing into the chamber and thereby maintain an aseptic condition of the fluid within the chamber. In each case, the method further comprises the step of sterilizing the sealed, empty flexible variable-volume storage chamber or other storage chamber prior to filling same. Preferably, the sterilizing step includes at least one of (i) transmitting radiation, such as gamma or e-beam radiation, and (ii) transmitting a fluid sterilant, such as VHP, onto the storage chamber.

In some embodiments of the present invention, the method comprises the step of aseptically filling the storage chamber with at least one of a milk-based product, a baby formula, and a water-based product. One such embodiment further comprises the step of maintaining the milk-based product, baby formula, or water-based product substantially preservative-free substantially throughout the filling and dispensing of the product. One such embodiment further comprises the step of maintaining the milk-based product, baby formula, or water-based product substantially at ambient temperature throughout the shelf-life and dispensing of multiple servings of the product from the storage chamber.

Some embodiments of the present invention further comprise the steps of: (i) providing a flexible tube coupled on one end in fluid communication with the storage chamber, and coupled on another end in fluid communication with a one-way valve assembly, and a pump in the form of a peristaltic pump; and (ii) engaging with the peristaltic pump an external portion of the flexible tube and pumping discrete portions of fluid therethrough.

Other embodiments of the present invention further comprise the steps of: (i) providing a pump in the form of a manually-engageable pump or pedal-actuated pump including a compression chamber, a compressive surface receivable within the compression chamber, and a manually-engageable actuator or pedal coupled to at least one of the compression chamber and compressive surface; and (ii) manually engaging the manually-engageable actuator or engaging the pedal and moving with the actuator or pedal at least one of the compressive surface and compression chamber relative to the other between a rest position and at least one actuated position and, in turn, pressurizing fluid within the compression chamber and dispensing fluid through the one-way valve assembly.

One advantage of the apparatus and method of the present invention is that the one-way valve assembly can hermetically seal the product in the variable-volume storage chamber throughout the shelf life and multiple dispensing of the product. As a result, non-acid products, such as milk-based products, do not require refrigeration during shelf life or usage of the product. Other advantages of the apparatus and method of the present invention will become readily apparent in view of the following detailed description and accompanying drawings.

DETAILED DESCRIPTION OF THE INVENTION

Figure 1:
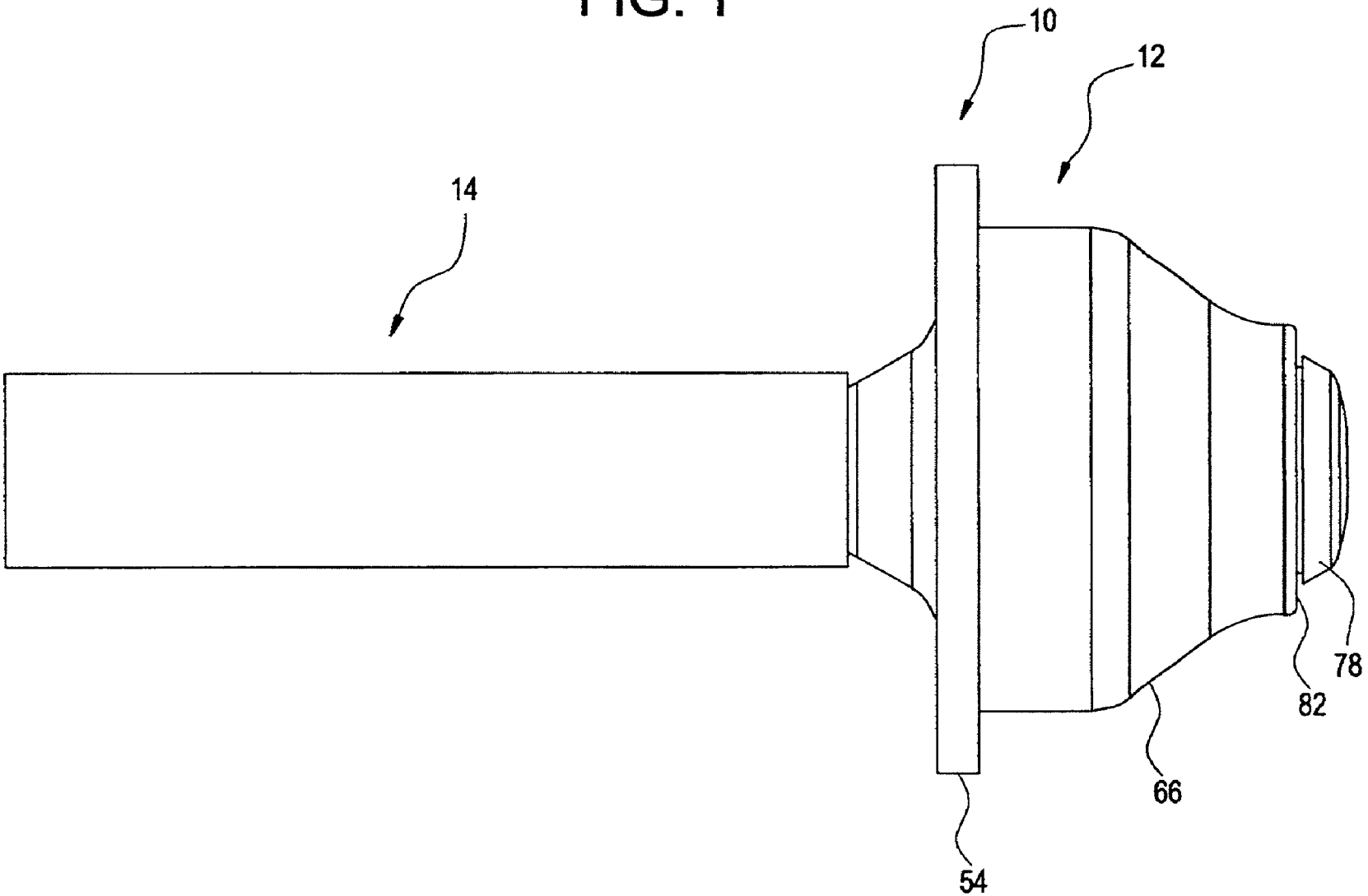
FIG. 1 is a side elevational view of an apparatus embodying the present invention including a one-way valve and tube assembly.
Figure 2:
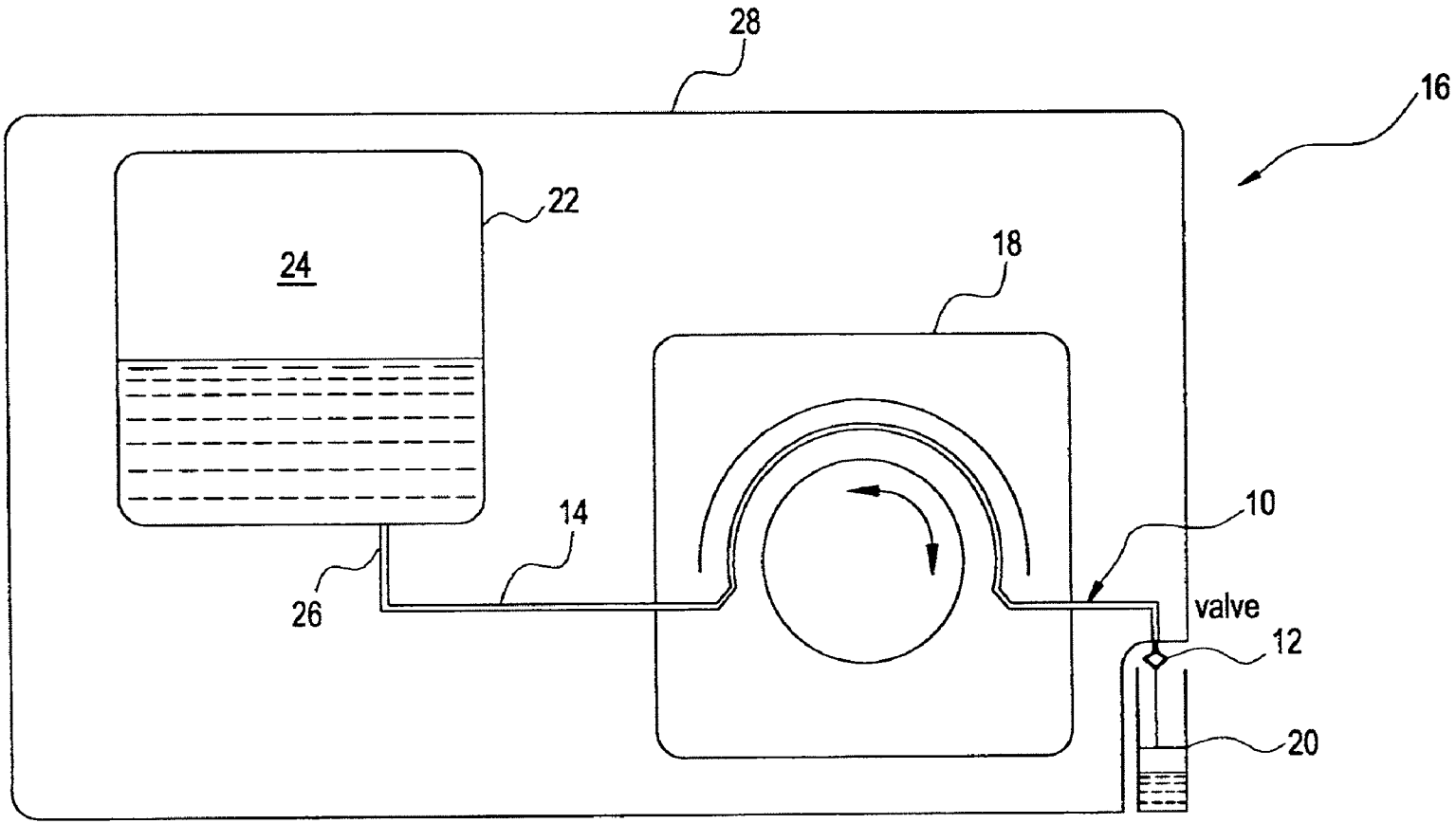
FIG. 2 is a somewhat schematic view of a dispenser employing the one-way valve and tube assembly in combination with a reservoir storing a substance to be dispensed, and a pump for pumping the substance from the reservoir through the tube and one-way valve assembly.

In FIGS. 1 and 2, an apparatus embodying the present invention is indicated generally by the reference numeral 10. The apparatus 10 comprises a one-way valve assembly 12 connected in fluid communication with a tube 14. The apparatus 10 is used to hermetically seal with respect to the ambient atmosphere a substance within the tube 14 and to dispense the substance through the one-way valve assembly 12. The substance may take the form of any of numerous different products that are currently known, or that later become known, including without limitation any of numerous different food and beverage products, such as milk-based products, including milk, evaporated milk, condensed milk, cream, half-and-half, baby formula, growing up milk, yogurt, soup, low acid fluids, no acid fluids, and any of numerous other liquid nutrition products, ice cream (including dairy and non-diary, such as soy-based ice cream), juice, syrup, coffee, condiments, such as ketchup, mustard, and mayonnaise, gases, such as coffee aroma, and biological or biopharmaceutical products, such as vaccines, monoclonal antibodies and gene therapies.

With reference to FIG. 2, the apparatus 10 is mountable within a dispenser 16 comprising a pump 18 that is connectable to the tube 14 to squeeze the tube and, in turn, dispense a substance within the tube through the one-way valve 12 and into a container 20. The dispenser also includes a reservoir 22 which in the illustrated embodiment defines a variable-volume storage chamber 24 for storing the substance to be dispensed. The reservoir 24 includes a fitting 26 connected to the end of the tube 24 opposite the one-way valve 12 and coupled in fluid communication between the tube and variable-volume storage chamber 24 for allowing the passage of substance from the storage chamber into the tube. Alternatively, the tube may be heat sealed, welded, adhesively attached, or otherwise connected to the reservoir, or material forming the reservoir, such as a plastic or laminated pouch, in any of numerous different ways that are currently known, or that later become known. The dispenser 16 also includes a housing 28 for enclosing the components as illustrated, and includes access panels or other openings in a manner known to those of ordinary skill in the pertinent art to allow access to the interior of the housing to install a fresh reservoir when the reservoir is emptied, and/or to repair or replace components.

Figure 3:
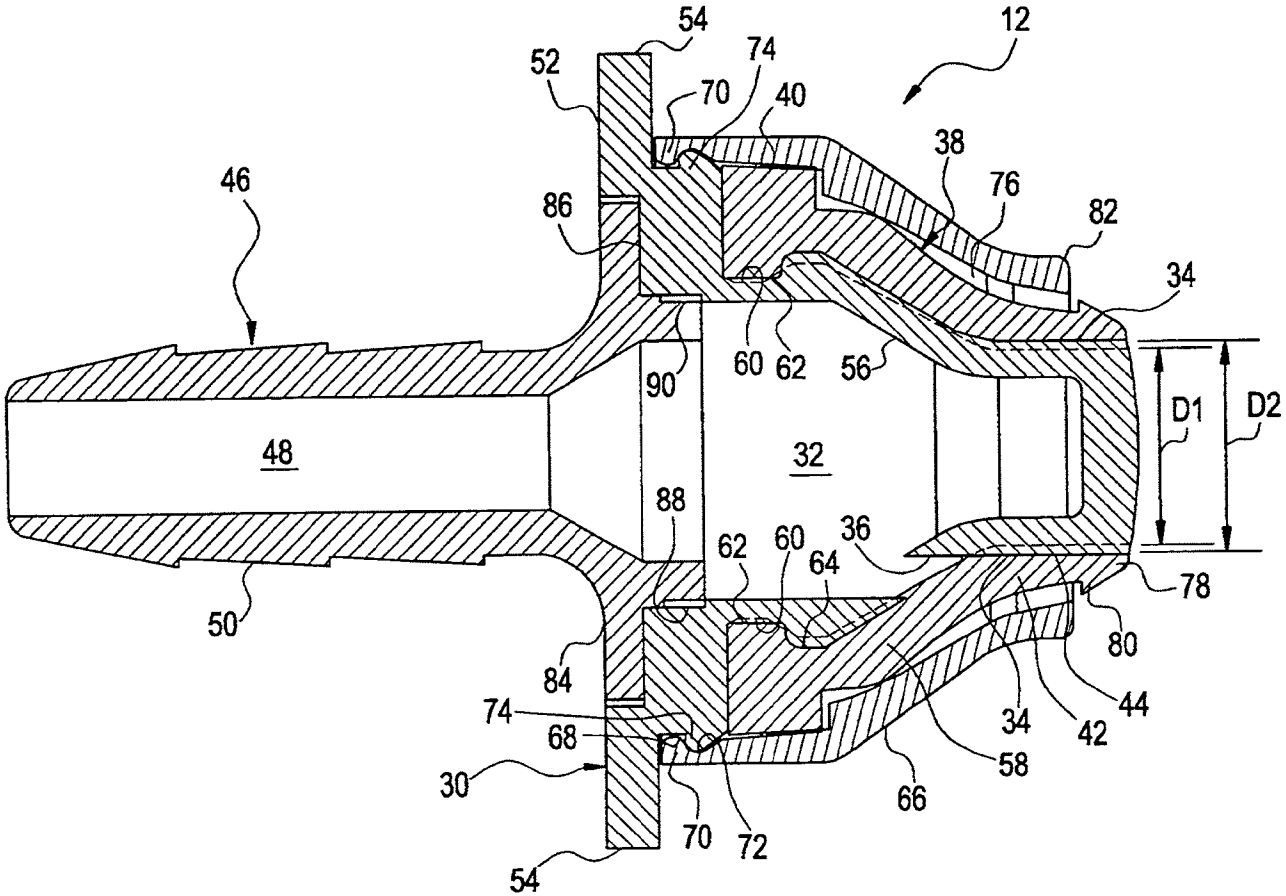
FIG. 3 is a cross-sectional view of the one-way valve assembly of FIG. 1.
Figure 4:
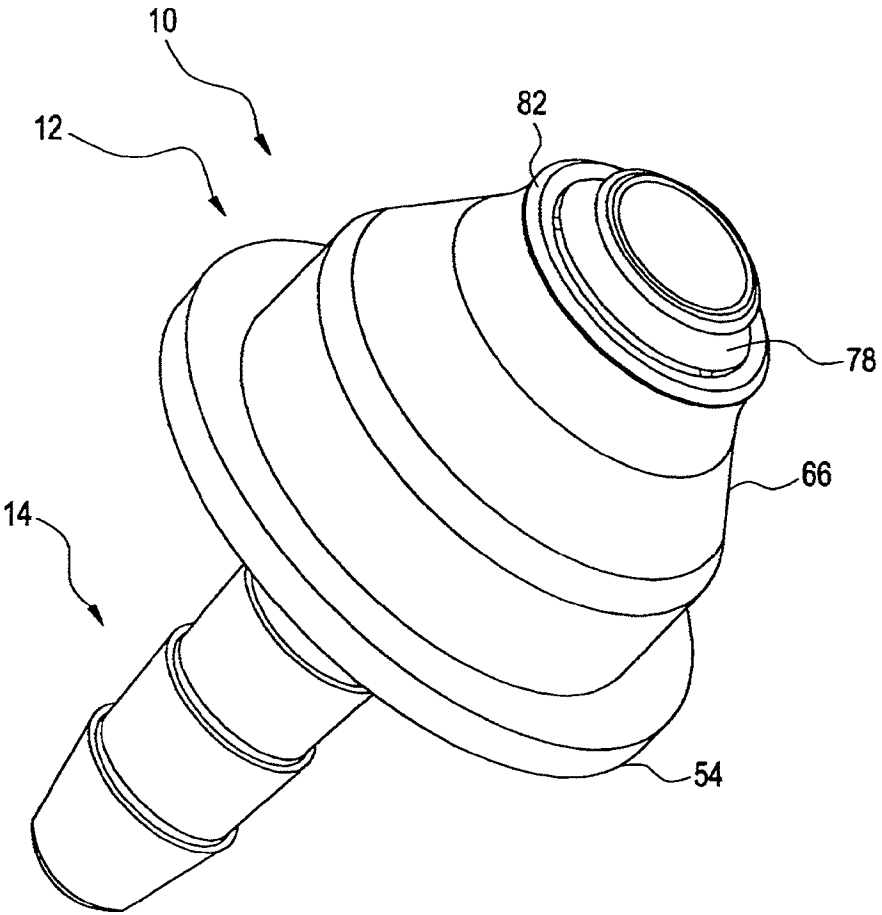
FIG. 4 is a front perspective view of the one-way valve assembly of FIG. 1.

As shown in FIG. 3, the one-way valve assembly 12 includes a valve body 30 defining a first axially-extending passageway 32, an axially-extending valve seat 34, and a flow aperture 36 axially extending through the valve body 30 adjacent to the valve seat 34 and coupled in fluid communication with the first axially-extending passageway 32. The one-way valve assembly 12 further includes a valve cover 38 formed of an elastic material and including a cover base 40 mounted on the valve body 30 and fixedly secured against axial movement relative thereto, and a valve portion 42 overlying the valve seat. The valve portion 42 defines a predetermined radial thickness and an inner diameter D1 less than the outer diameter D2 of the valve seat 34 to thereby form an interference fit therebetween, as indicated by the overlapping lines in FIG. 3. As can be seen, the valve portion 42 and the valve seat 34 define a normally closed, axially-extending valve opening or seam 44 therebetween. As described further below, the valve portion 42 is movable radially between a normally closed position, as shown in FIG. 3, with the valve portion 42 engaging the valve seat 34, and an open position (not shown) with at least a segment of the valve portion 42 spaced radially away from the valve seat 34 to connect the valve opening 44 in fluid communication with the flow aperture 36 to thereby allow the passage of substance from the flow aperture 36 through the valve opening 44. As also shown in FIG. 3, a fitting 46 is fixedly secured to the valve body 30 and forms a hermetic seal therebetween. The fitting 46 defines a second passageway 48 coupled in fluid communication with the first axially-extending passageway 32 for allowing the flow of substance therebetween, and an annular, axially-extending tube connection surface 50 that is hermetically connectable to the tube 14 with the second passageway 48 coupled in fluid communication with the tube to thereby allow the passage of substance from the tube 14, through the second passageway 48 and, in turn, through the first axially-extending passageway 32, flow aperture 36 and valve opening 44.

As shown in FIG. 3, the valve body 30 further includes a body base 52 including an annular mounting flange 54 extending radially outwardly therefrom for mounting the valve assembly in, for example, the dispenser 16 of FIG. 2. The valve body 30 also defines a first substantially frusto-conical portion 56 extending between the body base 52 and the valve seat 34. As can be seen, the flow aperture 36 extends axially through the first substantially frusto-conical portion 56 such that the radially inner edge of the flow aperture 36 is substantially contiguous to the valve seat 34. The valve cover 38 includes a second substantially frusto-conical shaped portion 58 extending between the cover base 40 and valve portion 42, overlying the first substantially frusto-conical shaped portion 56 of the valve body 30, and, as indicated by the overlapping lines in FIG. 3, forming an interference fit therebetween.

As can be seen in FIG. 3, the substantially frusto-conical and valve portions 58 and 42, respectively, of the valve cover 38 each define a progressively decreasing radial thickness when moving axially in a direction from the substantially frusto-conical portion 58 toward the valve portion 42. As a result, progressively less energy is required to open the valve when moving axially in the direction from the interior toward the exterior of the valve. Substance is dispensed through the valve by pumping the substance at a sufficient pressure (either by manually, mechanically or electro-mechanically squeezing the tube 14, or otherwise pumping the substance through the tube or into the valve) through the flow aperture 36 to open the valve opening or seam 44 (the "valve opening pressure"). Once the pressurized substance enters the valve opening or seam 44, progressively less energy is required to radially open respective axial segments of the valve cover when moving axially in the direction from the interior toward the exterior of the valve. As a result, the valve itself operates as a pump to force the substance through the normally-closed valve opening 44. Preferably, a substantially annular segment of the valve portion 42 engages the valve seat 34 substantially throughout any period of dispensing substance through the valve opening 44 to maintain a hermetic seal between the valve opening 44 and ambient atmosphere. If desired, the valve can be configured in other ways in order to require progressively less energy to open the valve (i.e., to decrease the valve opening pressure) when moving in the axial direction from the interior toward the exterior of the valve. For example, the valve cover 38 and valve body 30 may define a decreasing degree of interference therebetween when moving in a direction from the interior toward the exterior of the valve assembly. Alternatively, the valve seat 34 may define a progressively increasing diameter when moving axially in a direction from an inner end toward a distal end of the valve seat (or from the interior end toward the exterior end of the valve seat). If desired, the valve assembly may include only one of these features, or may include any desired combination of these features in order to achieve the desired performance characteristics.

The valve assembly 12 otherwise is preferably constructed in accordance with the teachings of the following commonly assigned, co-pending patent applications which are hereby incorporated by reference in their entireties as part of the present disclosure: U.S. patent application Ser. No. 10/640,500, filed Aug. 13, 2003, entitled "Container And Valve Assembly For Storing And Dispensing Substances, And Related Method", U.S. patent application Ser. No. 29/174,939, filed Jan. 27, 2003, entitled "Container and Valve Assembly", U.S. Patent Application 60/613,583, filed Sep. 27, 2004, entitled "Laterally-Actuated Dispenser with One-Way Valve for Storing and Dispensing Metered Amounts of Substances", U.S. patent application Ser. No. 29/188,310, filed Aug. 15, 2003, entitled "Tube and Valve Assembly", U.S. patent application Ser. No. 29/191,510, filed Oct. 7, 2003, entitled "Container and Valve Assembly", and U.S. Patent Application Ser. No. 60/528,429, filed Dec. 10, 2003, entitled "Valve Assembly And Tube Kit For Storing And Dispensing Substances, And Related Method".

In accordance with such teachings, at least one of the valve seat diameter D2, the degree of interference between the valve portion 42 and valve seat 34 (as indicated by the overlapping lines in FIG. 3), the predetermined radial thickness of the valve portion 42, and a predetermined modulus of elasticity of the valve cover 38 material, is selected to (1) define a predetermined valve opening pressure generated upon squeezing the tube 14 that allows passage of the substance from the tube through the normally-closed valve opening 44, and (2) hermetically seal the valve 12 and prevent the ingress of bacteria or contamination through the valve opening 44 and into the tube 14 in the normally closed position. In the illustrated embodiment of the present invention, each of the valve seat diameter D2, the degree of interference between the valve portion 42 and valve seat 34, the predetermined radial thickness of the valve portion 42, and the predetermined modulus of elasticity of the valve cover 38 material, is selected to (i) define a predetermined valve opening pressure generated upon squeezing the tube 14 that allows passage of the substance from the tube (or variable-volume storage chamber coupled in fluid communication thereto) through the valve opening 44, and (2) hermetically seal the valve opening 44 and prevent the ingress of bacteria through the valve opening and into the tube in the normally-closed position.

The flow aperture 36 extends angularly relative the valve seat. In the illustrated embodiment, the flow aperture extends angularly within the range of about 30° to about 45°. However, as may be recognized by those of ordinary skill in the pertinent art based on the teachings herein, this angular range is only exemplary, and may be changed as desired, or otherwise required. In addition, one or more additional flow apertures 36 may be added and angularly spaced relative to the aperture 36 as shown, for example, in any of the commonly-assigned, co-pending patent applications incorporated by reference above.

As shown in FIG. 3, the valve body 30 defines an annular recess 60 formed at the junction of the base 52 and frusto-conical portion 56. The valve cover 38 includes a corresponding annular flange 62 that projects radially inwardly, is received within the annular recess 60 of the valve body 30 to secure the valve cover to the valve body. As can be seen, the valve body 30 defines a tapered surface 64 on the axially outer or front side of the annular recess 62 to facilitate movement of the annular flange 62 into the annular recess 60.

The valve assembly 12 further includes a protective cover or shield 66 that extends annularly about the flexible valve cover 38, and extends axially from the base of the valve cover 38 to a point adjacent to the dispensing tip of the valve but spaced axially inwardly therefrom. As shown in FIG. 3, the valve body 30 defines a first peripheral recess 68 formed at the junction of the mounting flange 54 and body base 52, and the valve shield 66 defines a first corresponding annular protuberance 70 that projects radially inwardly and is snap fit into the peripheral recess 68 to lock the valve shield to the valve body. In addition, the valve shield 66 defines a second peripheral recess 72 formed on the axially inner side of the first annular protuberance 70, and the body base 52 defines a second corresponding annular protuberance 74 that projects radially outwardly and is snap fit into the peripheral recess 72 to further lock the valve shield to the valve body.

As also shown in FIG. 3, the valve shield 66 is spaced radially relative to the second frusto-conical portion 58 and valve portion 42 of the valve cover 38 to form an annular, axially extending gap 76 therebetween. The gap 76 allows the valve cover to freely expand or move radially outwardly during dispensing of substance through the normally closed valve opening or seam 44. The tip 78 of the valve portion 42 defines an annular portion 80 that tapers radially outwardly toward the distal end 82 of the valve shield 66 to substantially block, or block a substantial portion of, the distal end of the annular gap 76 to thereby prevent any unwanted substances from becoming deposited therein.

The fitting 46 includes an annular mounting flange 84 that is received within a corresponding mounting recess 86 to mount the fitting to the valve body 30. As shown in FIG. 3, the fitting and valve body form an interference at the inner annular surfaces 88 and 90 thereof to allow the fitting and valve body to be ultrasonically welded to each other and form a hermetic seal therebetween at the annular engagement line of these surfaces. One advantage of the illustrated shear joint design is that it ensures relatively high joint strength and a hermetic seal throughout. As may be recognized by those of ordinary skill in the pertinent art based on the teachings herein, the fitting and valve body may be connected to one another in any of numerous different ways that are currently known, or that later become known. Alternatively, the fitting and valve body may be formed integral with each other when molding the valve body and fitting. One advantage of forming the fitting separate from the valve body is that the different sizes of fittings, and/or different types of fittings, may be attached to the valve bodies. As shown in FIG. 3, the tube connection surface 50 is a conventional barbed fitting surface that frictionally engages the interior of the flexible tube 14 to secure the fitting to the tube and form a hermetic seal therebetween. In the illustrated embodiment, the tube 14 is a conventional silicone tube. However, as may be recognized by those of ordinary skill in the pertinent art based on the teachings herein, the fitting and/or tube may take the form of any of numerous different configurations and/or may be formed of any of numerous different materials that are currently known, or that later become known.

As shown in FIG. 2, the valve and tube assembly 10 may be mounted within a dispenser 16 and connected to a conventional peristaltic pump 18 that is rotatably driven, as indicated by the arrows in FIG. 2, to squeeze the tube 14 and, in turn, pump substance from the reservoir 24, through the one-way valve 12, and into a receiving container or other receptacle 20. Alternatively, the valve and tube assembly 10 may be mounted within any of numerous different containers or dispensers, and may be used in combination with any of numerous different pumps, such as electrically-actuated, manually-actuated, or pedal actuated pumps, or may be used with dispensers that employ pressurized air or other gas to pump the fluid through the valve, that are currently known, or that later become known.

Figure 6:
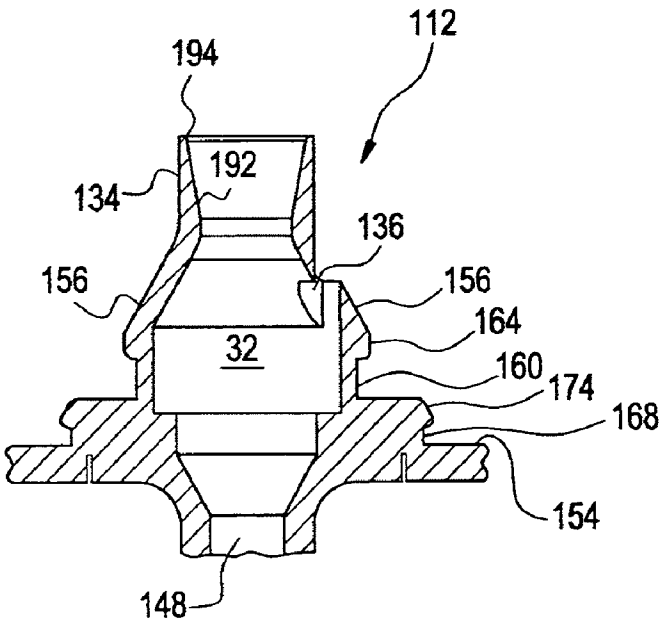
FIG. 6 is a partial, cross-sectional view of the valve body and fitting of the one-way valve assembly of FIG. 5.
Figure 5:
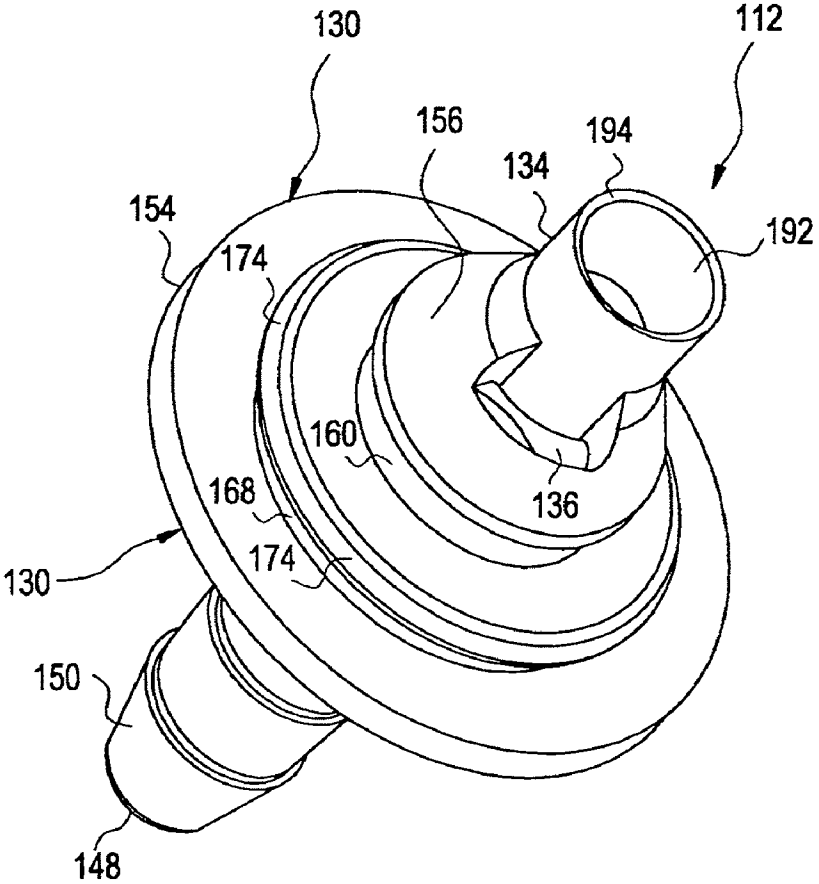
FIG. 5 is a front perspective view of another embodiment of a one-way valve assembly with the flexible valve cover removed, and including a chamfered edge at the dispensing tip for preventing the collection of substance at the tip after dispensing.

In FIGS. 5 and 6, another valve assembly embodying the present invention is indicated generally by the reference numeral 112. The valve assembly 112 is substantially similar to the valve assembly 12 described above, and therefore like reference numerals preceded by the numeral "1" are used to indicate like elements. The primary difference of the valve assembly 112 in comparison to the valve assembly 12 is that the dispensing tip of the valve seat 134 defines a recess 192 therein, and a very thin, annular, chamfered edge 194 formed between the recess 192 and the distal edge of the valve seat 134. As can be seen, the radial width of the chamfered edge 194 is substantially less than the axial depth of the recess 192 and the diameter of the valve seat 134 (by a magnitude in both instances of at least about 5 and preferably of at least about 10). In one embodiment of the present invention, the radial width of the edge portion is within the range of about 5 mm to about 25 mm. One advantage of this configuration is that the thin, annular edge 194 substantially prevents any substance from collecting at the dispensing tip after being dispensed from the valve. Preferably, the valve 112 is mounted in a substantially vertical or upright orientation (as shown typically in FIG. 2) such that the dispensing tip is facing downwardly (either such that the axis of the valve is oriented substantially perpendicular to, or at an acute angle relative to, the horizontal). The slight surface area of the annular edge 194 substantially prevents any fluid that flows onto the surface from having sufficient surface tension to overcome the force of gravity that pulls the fluid downwardly and away from such surface. As a result, the annular edge 194 substantially prevents any fluid or other substance from collecting thereon, and thus facilitates in maintaining a clean dispensing tip.

Figure 7:
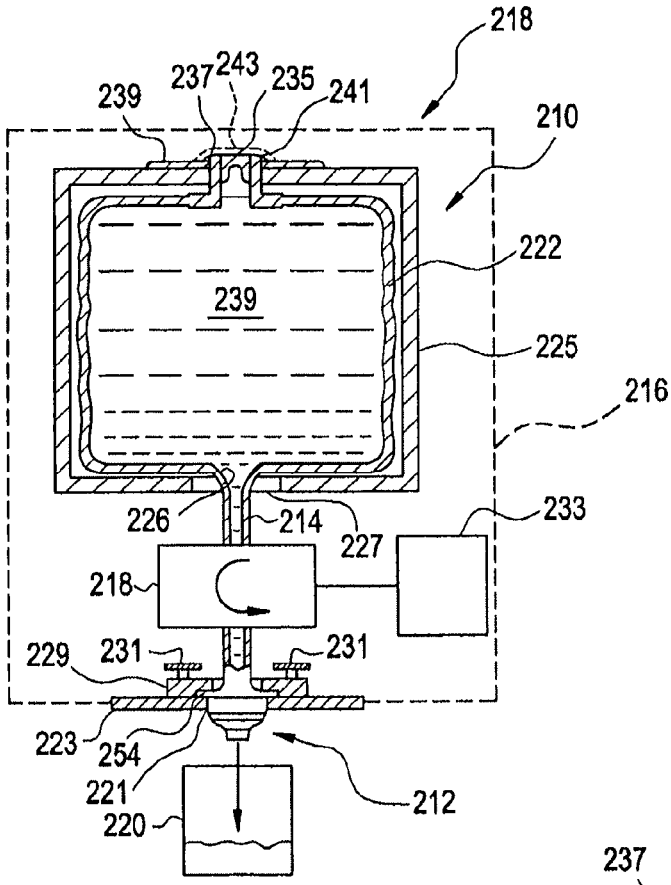
FIG. 7 is a partial cross-sectional, somewhat schematic view of a flexible pouch, tube and valve assembly received within a box and mounted within a dispenser.
Figure 8:
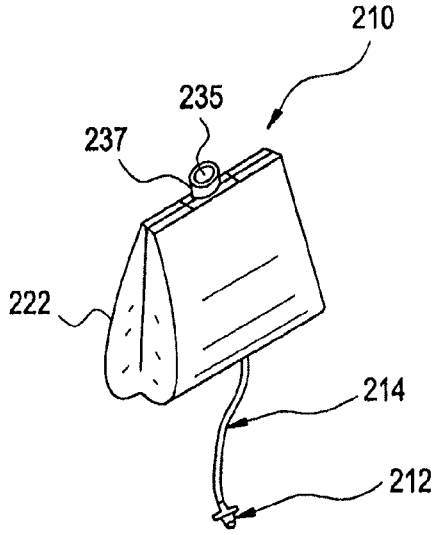
FIG. 8 is a perspective view of the flexible pouch, tube and valve assembly of FIG. 7.
Figure 9:
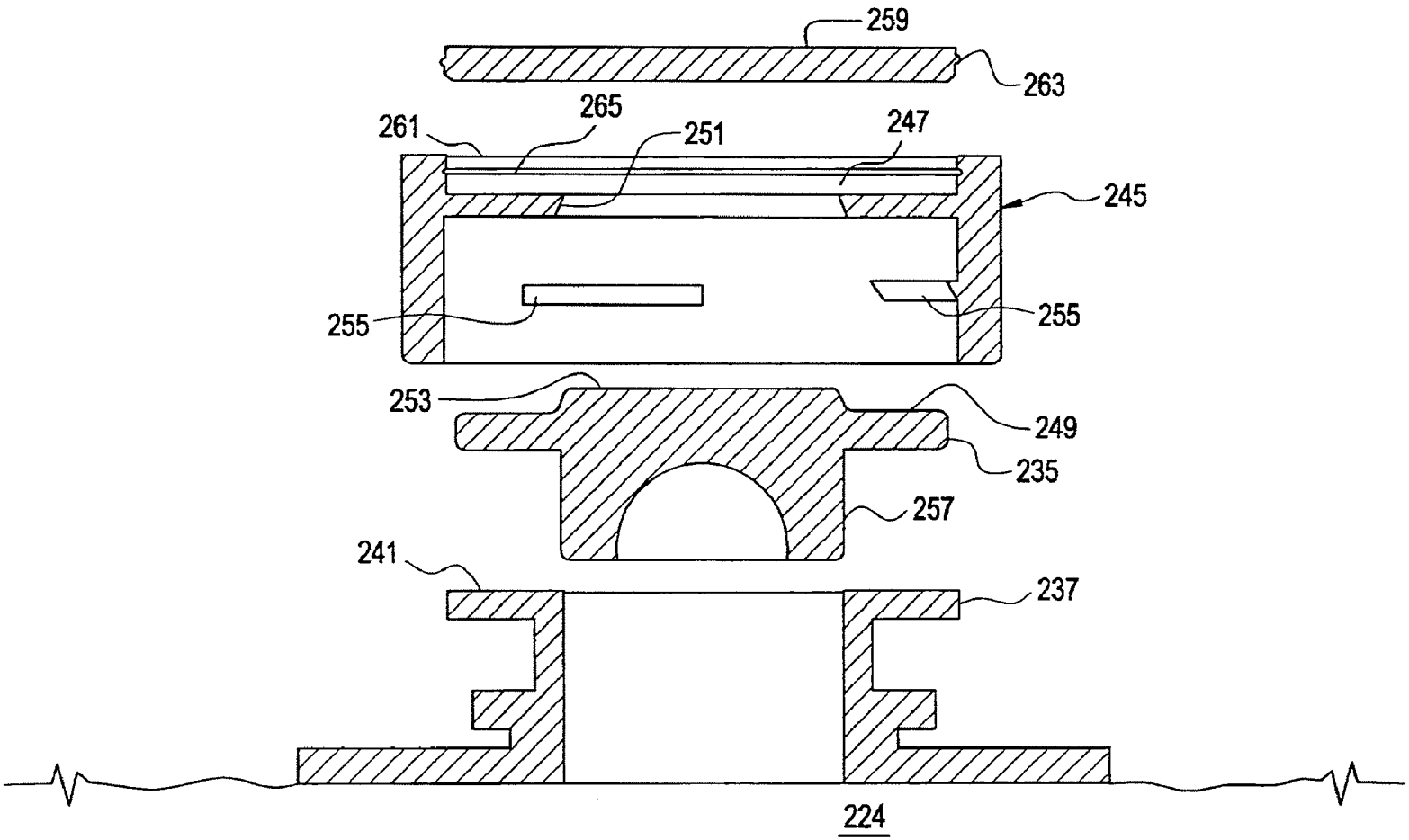
FIG. 9 is an exploded cross-sectional view of a port located on the flexible pouch of FIG. 7 that includes a needle penetrable and laser resealable stopper for needle penetrating the stopper and filling the pouch with a fluid therethrough and laser resealing the resulting needle hole in the stopper after withdrawing the needle therefrom.

In FIGS. 7-9, another tube and valve assembly embodying the present invention is indicated generally by the reference numeral 210. The tube and valve assembly 210 is substantially similar to the tube and valve assemblies 10, 110 described above, and therefore like reference numerals preceded by the numeral "2", or preceded by the numeral "2" instead of the numeral "1", are used to indicate like elements. A primary difference of the tube and valve assembly 210 in comparison to the tube and valve assemblies described above, is that the tube 214 is formed integral with a flexible pouch forming the reservoir 224, and the flexible pouch, tube and valve assembly may be mounted within a relatively rigid box 225. In one embodiment, the inlet end 226 of the tube 214 is built into the base of the pouch 222, such as by heat-sealing, ultrasonically welding, crimping, or adhesively attaching the tube to the pouch material. As may be recognized by those of ordinary skill in the pertinent art based on the teachings herein, the tube may be connected in fluid communication with the pouch, or formed integral with the pouch, in any of numerous different ways that are currently known, or that later become known.

As indicated in FIG. 7, when mounted within the dispenser housing 216, the tube 214 is coupled to a peristaltic pump 218 of a type known to those of ordinary skill in the pertinent art, and the valve assembly 212 extends through a dispensing opening 221 formed in a panel 223 of the dispenser housing 216. As can be seen, the mounting flange 254 is seated on the inner side of the panel 223, and a clamp 229 with one or more suitable fasteners 221, such as thumb screws, that releasably secure the valve 212 in place. A control unit 233 is electrically coupled to the pump 218 to control operation of the pump and, in turn, control dispensing of the food or beverage product or other substance within the reservoir 224 of the pouch 222 through the tube 214, one-way valve assembly 212, and into the cup or other receptacle 220. The dispenser may include suitable controls to allow a user to actuate the control unit 233 and pump 218, such as buttons or switches, all of a type known to those of ordinary skill in the pertinent art.

In one embodiment, the material of the pouch 222 is an oxygen/water barrier material. An exemplary such material is a plastic laminate with an approved food contact material layer. In one such embodiment, the material is a heat-sealable film including an oxygen/water barrier layer and, preferably, an outer layer exhibiting appropriate wear and flexibility properties. Examples of suitable outer layers are nylon, either linear or biaxially orientated, polyethylene, polypropylene, and polystyrene. Examples of oxygen/water barrier materials are ethylene vinyl alcohol (EVOH) and silicon oxide. An exemplary heat-sealable material is polyethylene, such as linear low-density, ultra linear low-density, high-density or metallocene catalyzed polyethylene. An exemplary pouch material is a laminate including a nylon co-polymer, on the outside, EVOH, and metallocene catalyzed polyethylene on the inside, wherein the layers of the laminate are adhered together in a manner known to those of ordinary skill in the pertinent art. As may be recognized by those of ordinary skill in the pertinent art, if the tube is not provided as an integral part of the pouch, anti-block additives should be avoided to ensure good pouch-edge/tube fusion.

The tube 214 preferably is made of a material that is sufficiently soft that it can be squeezed or otherwise deformed by, for example, the peristaltic pump 218, but does not puncture or permanently deform when so squeezed or deformed. In one embodiment of the present invention, the material is a co-extruded metallocene catalyzed polyethylene, such as the metallocene catalyzed resin sold by Dow Chemical Corporation under the designation Dow AG 8180. As indicated above, the tube material may be heat sealed, crimped, or adhesively attached to the pouch material.

The dimensions of the tube 214 can be adapted to the type of food material or other substance to be dispensed therethrough. In some embodiments, the internal diameter of the tube is within the range of about 5 mm to about 15 mm, and preferably is within the range of about 7 mm to about 8 mm. In some such embodiments, the thickness of the tube material is within the range of about 1 mm to about 2 mm, and in one such embodiment, the thickness is about 1.5 mm. The length of the tube 214 may be set as desired or otherwise required by a particular dispensing system. In some embodiments, the length of the tube is within the range of about 15 cm to about 25 cm. As may be recognized by those of ordinary skill in the pertinent art based on the teachings herein, the materials of construction of the pouch, tube and valve assembly, may take the form of any of numerous different materials that are currently known, or that later become known for performing the functions of the respective components. Similarly, the dimensions of these components, and the manner in which these components are connected or otherwise formed, may take any of numerous different dimensions or configurations as desired or otherwise required. For example, the materials of the pouch, or the dimensions of the pouch and tube, may be the same as disclosed in U.S. Pat. No. 6,024,252, which is hereby expressly incorporated by reference in its entirety as part of the present disclosure.

Depending on the design of the housing 216 of the dispenser, it may not be necessary to arrange the pouch 222 within the box 225. However, the box 225 can provide a convenient mechanism for holding and transporting the flexible pouch 222, and/or for mounting the pouch 222 within the dispenser housing 216. In one embodiment of the present invention, the box 216 is a cardboard box of a type known to those of ordinary skill in the pertinent art. As shown in FIG. 9, the box 225 may define an aperture 227 extending through a base wall thereof that allows the tube and valve assembly to be passed therethrough. Alternatively, the box 225 may be provided with a perforated or frangible portion allowing part of the box to be removed to access the tube and valve assembly. As may be recognized by those of ordinary skill in the pertinent art based on the teachings herein, the box may be formed of any of numerous different materials, and may define any of numerous different shapes and/or configurations, that are currently known, or that later become known. In addition, the flexible pouch and valve assembly may be mounted within any of numerous different containers or dispensers, and may be used in combination with any of numerous different pumps, such as electrically-actuated, manually-actuated, or pedal actuated pumps, or may be used with dispensers that employ pressurized air or other gas to pump or otherwise pressurize the fluid to flow through the valve, that are currently known, or that later become known.

As shown in FIGS. 7-9, the pouch 222 preferably includes a needle penetrable and thermally resealable stopper 235 for filling the reservoir 224 through the stopper with a needle or other injection member, and thermally resealing the resulting needle hole with a laser or other thermal or chemical source. As can be seen, the stopper 235 is mounted or otherwise received within a port 237 extending through an upper portion of the pouch 222. As shown in FIG. 9, the port 237 may extend through an aperture formed in an upper wall of the box 225. If desired, a support ring 239 may be located between a flange 241 of the port 237 and the adjacent wall of the box 225. As can be seen, the support ring 239 extends laterally (or radially outwardly) from the port to support the port during needle filling and resealing through the stopper. The pouch, tube and valve assembly are preferably sterilized prior to filling, by, for example, applying radiation, such as gamma or ebeam radiation thereto, or another type of sterilant, such as vaporized hydrogen peroxide ("VHP"). Then, the hermetically sealed, sterilized, empty pouch, tube and valve assemblies are aseptically filled with a liquid food, drink or other substance to be contained therein. One advantage of this filling method and construction is that it provides for improved shelf-life of the substance within the pouch, and allows the pouch to be non-refrigerated during storage and throughout the usage of the pouch (i.e., the pouch may remain non-refrigerated from the first to the last dose dispensed from the pouch).

If desired, and as indicated typically in broken lines in FIG. 7, a tamper-proof cover 243 may be secured to the flange 241 of the port after needle filling through, and thermally resealing the stopper 235 in order to prevent removal of the stopper, or otherwise tampering with the stopper, without damaging the cover 243. The stopper 235 forms a fluid-tight peripheral seal with the port 237 in a manner known to those of ordinary skill in the pertinent art. In addition, the cover 243 may form a fluid tight seal between the stopper and the ambient atmosphere and, in turn, provide additional moisture and/or vapor transmission barrier between the stopper and ambient atmosphere. The cover 243 may be connected to the port in any of numerous different ways that are currently known, or that later become known, including by a snap-fit connection, ultrasonic welding, adhesive, or otherwise.

As shown in FIG. 9, in an alternative configuration, the stopper 235 may be retained within the port 237 by a cover 245 that is snap-fit to the port 237 to fixedly secure the stopper within the port. The cover 245 includes an internal flange 247 that engages a peripheral flange 249 of the stopper 235 to fixedly secure the stopper to the port. The internal flange 247 defines a central aperture 251 for receiving therein a central raised portion 253 of the stopper 235 defining the needle penetrable and thermally resealable portion of the stopper. The cover 245 further defines a plurality of snapping flanges 255 angularly spaced relative to each other below the internal flange 247. Each snapping flange 255 defines a tapered cross-sectional configuration to permit the cover 245 to be slidably mounted over the flange 237 of the port 239 and to form a snap-fit in engagement with the underside of the flange 237 of the port to prevent the cover from being removed from the port. Preferably, when snapped in place, the internal flange 247 applies a substantially predetermined compressive preload to the elastic flange 249 of the stopper 235 to thereby form a fluid-tight seal between the cover, stopper and port. In addition, the internal peripheral edge 257 of the stopper is configured in a manner known to those of ordinary skill in the pertinent art based on the teachings herein to engage the internal surfaces of the port 237 and form a fluid-tight seal therebetween throughout the shelf-life and usage of the pouch. The cover 245 includes a cover disk 259 that is received within a peripheral recess 261 formed within the cover on the upper side of the internal flange 247. The cover disk 259 defines an annular protuberance 263, and the cover disk defines an annular recess 265 for receiving therein the annular protuberance of the cover and thereby fixedly securing the cover disk thereto. The cover disk 259 is fixedly secured to the cover after needle penetrating and thermally resealing the region 253 of the stopper to thereby prevent access to the stopper and provide an added barrier to prevent the transmission of moisture, vapor, or gas through the stopper.

Figure 10:
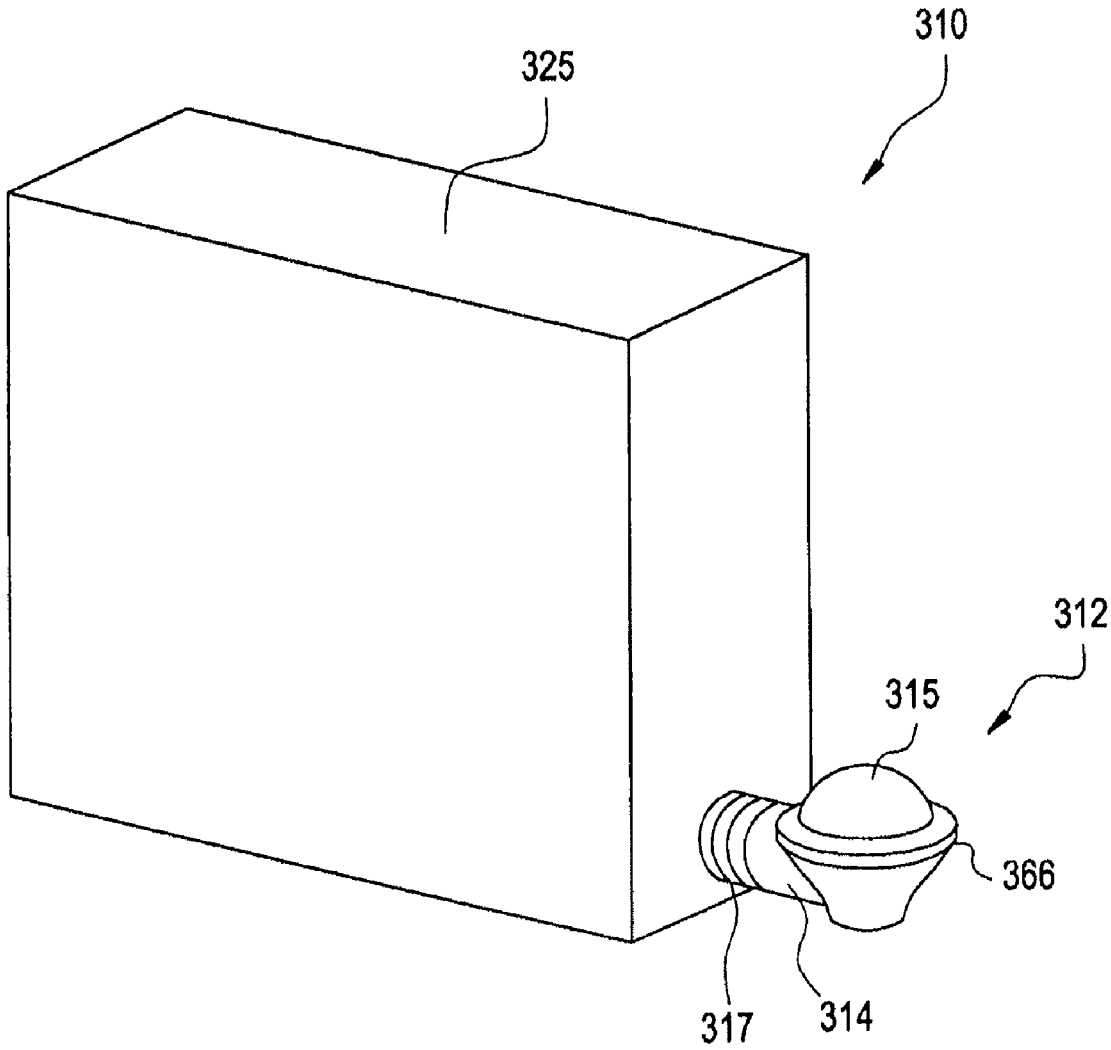
FIG. 10 is a perspective view of another embodiment of a valve assembly of the present invention including a manually engageable, dome-shaped actuator for pumping fluids through the valve, wherein the valve is mounted on a box and coupled in fluid communication with a flexible pouch located within the box.

In FIGS. 10-13 another assembly embodying the present invention is indicated generally by the reference numeral 310. The assembly 310 is similar in many respects to the assembly 210 described above with reference to FIGS. 7-9, and therefore like reference numerals preceded by the numeral "3" instead of the numeral "2" are used to indicate like elements. As shown in FIG. 10, the one-way valve assembly 312 includes a manually engageable, dome-shaped actuator 315 for dispensing substantially metered amounts of fluid from a pouch 322 (FIG. 14) defining a variable-volume storage chamber 324 through the valve. The valve assembly 312 includes an integral rigid tube 314 defining on an upstream end thereof a mounting flange 317 for mounting the tube and valve assembly to a relatively rigid box 325 that contains therein the flexible pouch 322 (FIG. 14). The box 325 and pouch 322 may be the same as or substantially similar to the box and pouch described above, or may be made of any of numerous different materials, and/or may take any of numerous different shapes and/or configurations that are currently known or that later become known.

Figure 11:
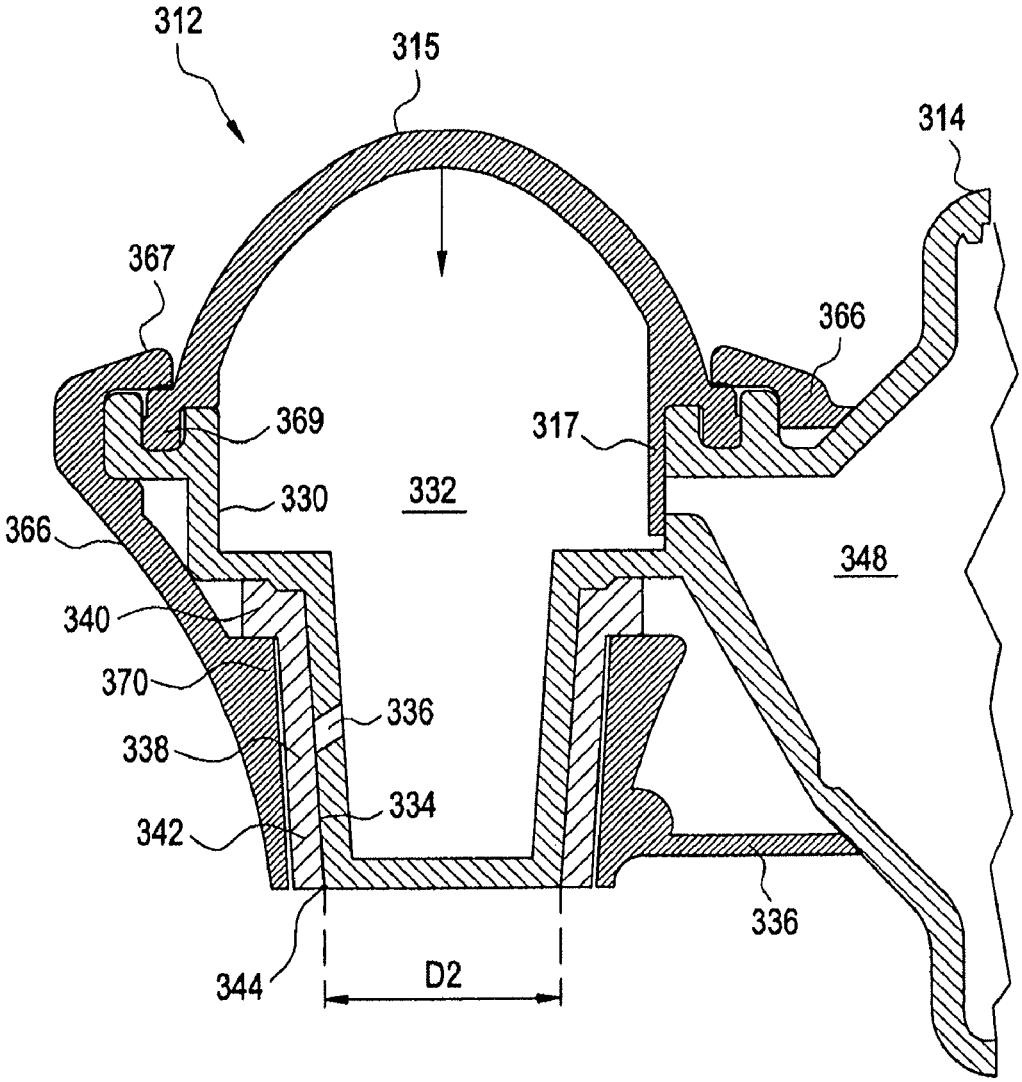
FIG. 11 is a cross-sectional view of the valve assembly of FIG. 10.

The dome-shaped actuator 315 is made of an elastomeric material that is flexible and can be manually engaged and pressed inwardly to operate the actuator and thereby pump fluid from the variable-volume storage chamber 324 through the one-way valve 312. As shown in FIG. 11, the one-way valve 312 includes a flap 317 extending inwardly from the actuator 315, a valve body 330 defining a compression chamber 332 for receiving therein from the variable-volume storage chamber 324 each dosage or discrete portion or serving of fluid to be dispensed, a relatively rigid valve seat 334, and at least one flow aperture 336 extending through the valve body 330 adjacent to the valve seat 334 and coupled in fluid communication with the compression chamber 332. The one-way valve assembly 312 further includes a valve cover 338 formed of an elastic material and including a cover base 340 mounted on the valve body 330 and fixedly secured against axial movement relative thereto, and a valve portion 342 overlying the valve seat 334. The valve portion 342 and valve body 330 form an interference fit therebetween. As can be seen, the valve portion 342 and the valve seat 334 define a normally closed, axially-extending valve opening or seam 344 therebetween. The valve portion 342 is movable radially between a normally closed position, as shown, with the valve portion 342 engaging the valve seat 334, and an open position (not shown) with at least a segment of the valve portion 342 spaced radially away from the valve seat 334 to connect the valve opening 344 in fluid communication with the flow aperture 336 and thereby allow the passage of fluid from the compression chamber 332 to the flow aperture 336 and through the valve seam 344.

Figure 12:
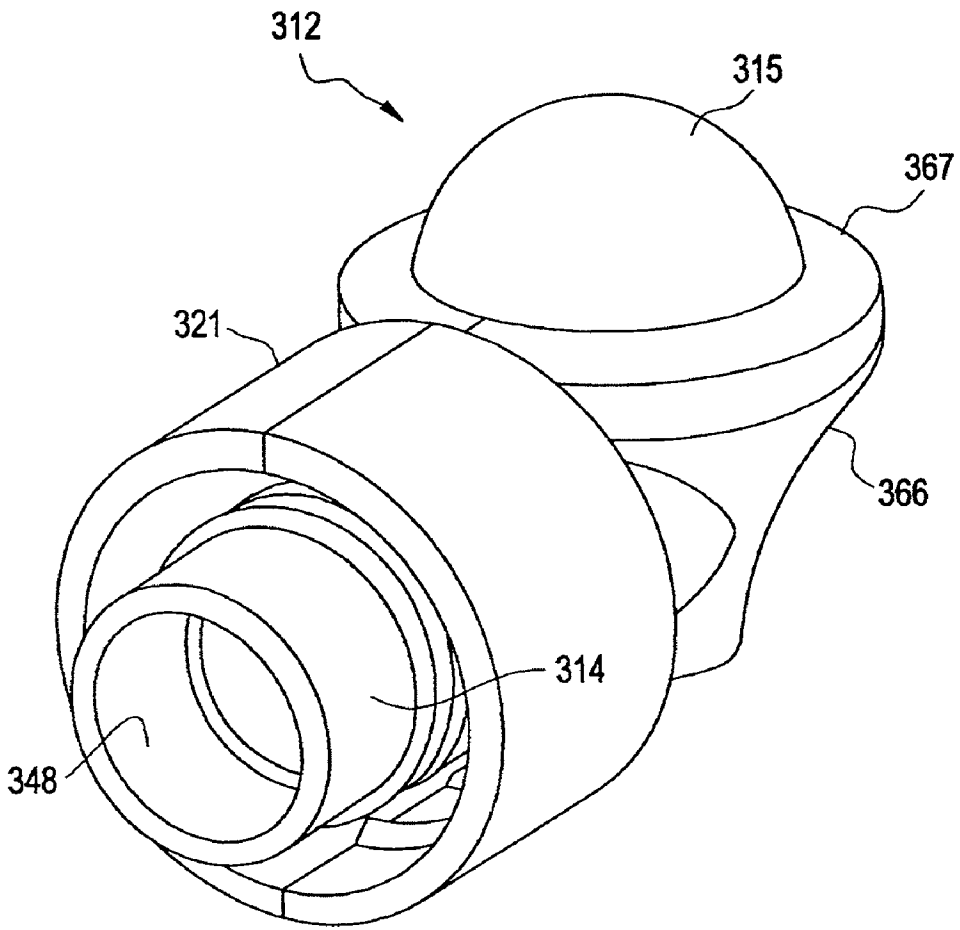
FIG. 12 is a rear perspective view of the valve assembly of FIG. 11.

The one-way valve 312 also includes an inlet passageway 348 extending through the tube 314 and coupled in fluid communication with the variable-volume storage chamber 324 (FIG. 12). The one-way valve 312 may be connected directly to the variable-volume storage chamber 324 and then welded or otherwise sealed to the pouch 322 so as to prevent contaminants from entering the compression chamber or valve. Alternatively, the inlet passageway 348 can be coupled to a flexible tube of the type shown, for example, in FIG. 2, and the flexible tube can, in turn, connect the valve 312 to the storage chamber 324. As can be seen, in its normally-closed position, the flap 317 separates the compression chamber 332 from the inlet passageway 348 and storage chamber 324. Thus, during the downward stroke of the dome-shaped actuator 315, as indicated by the arrow in FIG. 11, the flap 317 prevents the fluid within the compression chamber 332 from flowing rearwardly back into the inlet aperture 348 and variable-volume storage chamber 324, and in turn allows the manually depressed actuator to pressurize the fluid in the compression chamber sufficiently to overcome the valve opening pressure and be dispensed through the valve. Then, during the upward or return stroke of the dome-shaped actuator 315, the suction force or vacuum created within the compression chamber causes the flap 317 to flex away from the inlet aperture, as indicated by the arrow in FIG. 11, to thereby place the compression chamber 332 in fluid communication with the inlet passageway 348 and allow the next dose of fluid to flow into the compression chamber.

The valve assembly 312 otherwise may be constructed in accordance with the teachings of the commonly assigned, co-pending patent applications incorporated by reference above. In accordance with such teachings, at least one of the valve seat diameter D2 (as shown in FIG. 11, the valve seat defines a gradually decreasing diameter when moving from the upstream toward the downstream end of the valve seat), the degree of interference between the valve portion 342 and valve seat 334, the predetermined radial thickness of the valve portion 342, and a predetermined modulus of elasticity of the valve cover 338 material, is selected to (1) define a predetermined valve opening pressure generated upon depressing the dome shaped actuator 315 that allows passage of fluid from the compression chamber 332 through the normally-closed valve opening 344, and (2) hermetically seal the valve 312 and prevent the ingress of bacteria or other contaminants through the valve opening 344 and into the passageway 348 in the normally closed position. In the illustrated embodiment of the present invention, each of the valve seat diameter D2, the degree of interference between the valve portion 342 and valve seat 334, the predetermined radial thickness of the valve portion 342, and the predetermined modulus of elasticity of the valve cover 338 material, is selected to (i) define a predetermined valve opening pressure generated upon depressing the actuator 315 that allows passage of a substantially predetermined volume of fluid from the reservoir 324 into the chamber 332 and through the valve opening 344, and (2) hermetically seal the valve opening 344 and prevent the ingress of bacteria or other contaminants through the valve opening in the normally-closed position.

The valve assembly 312 further includes a protective cover or shield 366 (not shown in FIG. 10) that extends annularly about the flexible valve cover 338, and extends axially from the base of the valve cover 338 to a point adjacent to the dispensing tip of the valve but spaced axially inwardly therefrom. The shield 366 is mounted to the valve body 330 and includes a peripheral flange 367 that compressively engages a corresponding peripheral flange 369 of the dome-shaped actuator 315 to fixedly secure the dome-shaped actuator to the valve body, and includes a lower annular flange 371 that compressively engages the cover base 340 of the valve cover to fixedly secure the valve cover to the valve body.

The one-way valve assembly 312 operates as follows. The dome-shaped actuator 315 is pressed downward, such as my manual engagement, to pressurize and in turn displace a substantially predetermined volume of fluid located within the compression chamber 332. The resulting fluid pressure within the compression chamber 332 causes the flap 317 to seal itself against the valve body wall surrounding the inlet passageway 348 to thereby prevent fluid communication between the inlet passageway and compression chamber. If desired, the flap 317 and/or the wall surrounding the inlet passageway 348 may be angled to assist in creating a seal between the flap and wall. A substantially predetermined volume of fluid then moves from the compression chamber 332 through the flow aperture 336, into valve seat 334, and out through the valve opening 344. When the actuator 315 is pressed downwardly, the chamber 332 is emptied or substantially emptied. When the user releases the actuator 315, a vacuum is created within the chamber 332 and the flap swings outwardly away from passageway 348, as indicated by the arrow in FIG. 11, which allows fluid to flow from the reservoir 324 into the compression chamber 332.

Figure 13:
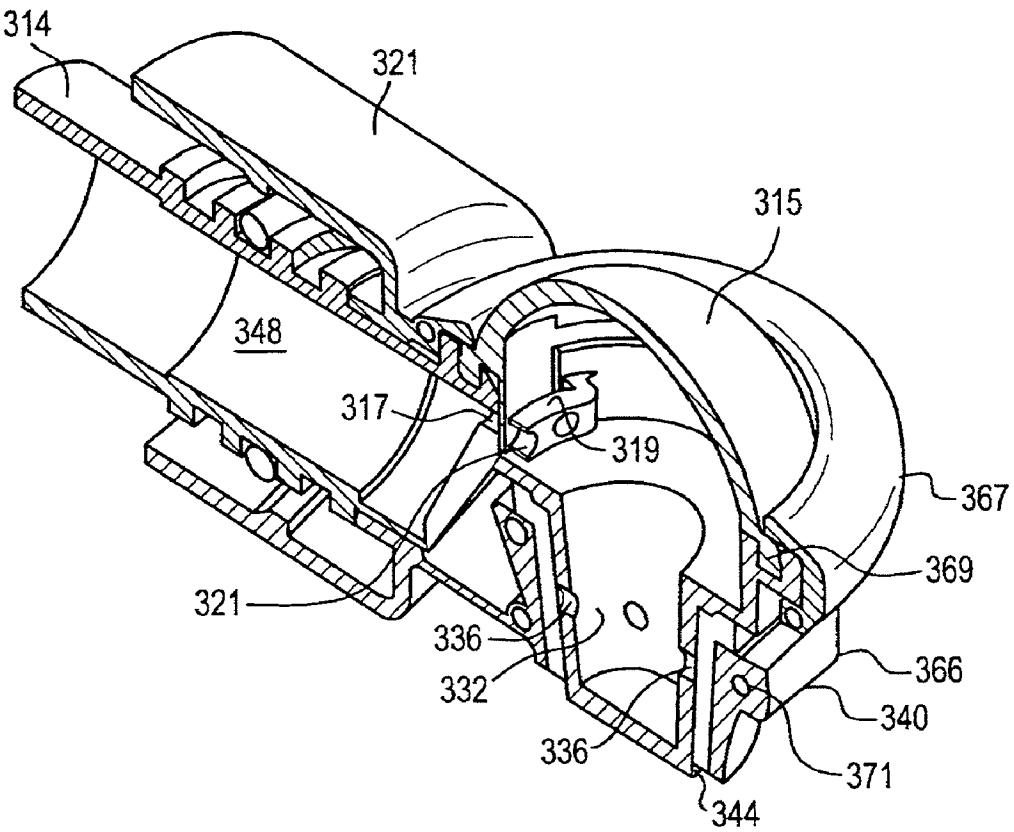
FIG. 13 is an upper perspective, cross-sectional view of the valve assembly of FIG. 11.
Figure 14:
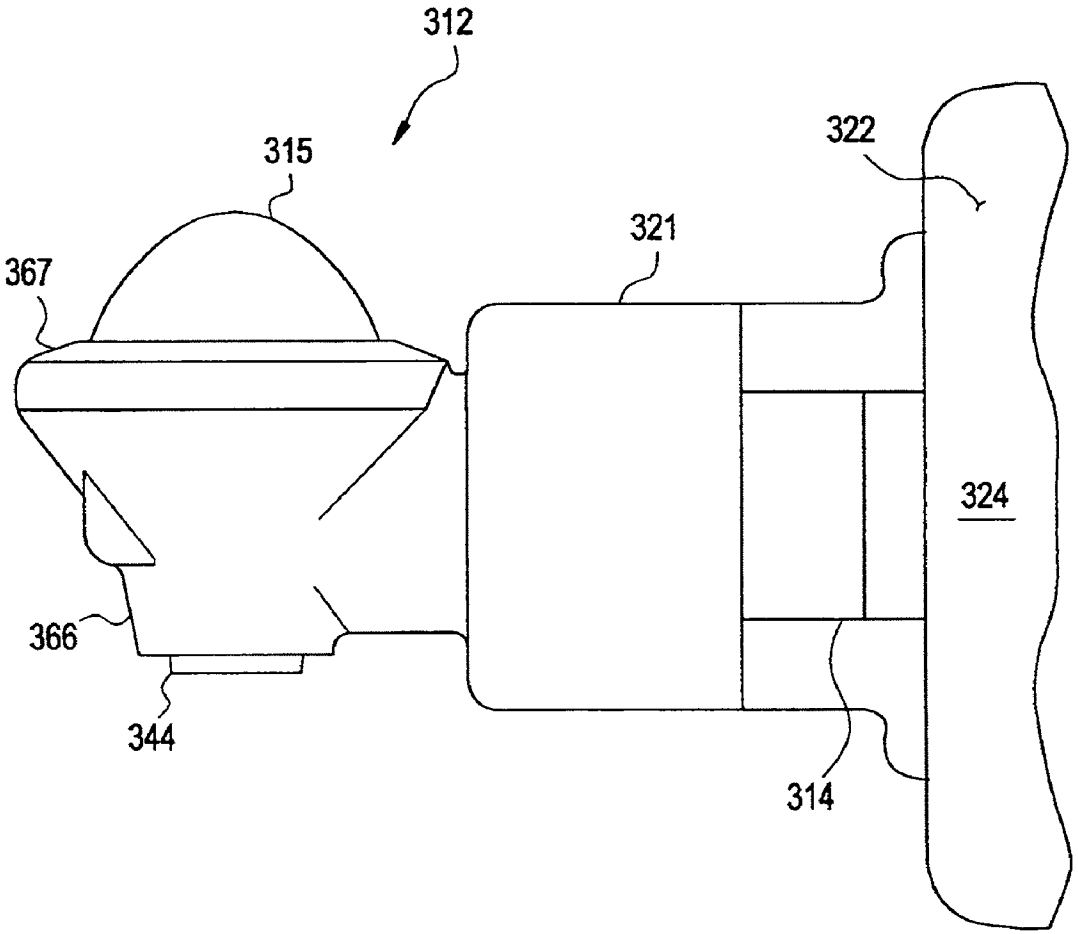
FIG. 14 is a side elevational view of the valve assembly of FIG. 11 attached to the flexible pouch.

If desired, and as shown typically in FIG. 13, the valve body 330 may include an arm 319 that is spaced downstream of, and adjacent to the flap 317 a distance sufficient to define a gap 321 between the arm and flap when the flap is located in the normally closed position. The arm 319 operates as a stop to prevent further downstream movement of the flap and thereby prevent the flap from swinging out of position. As shown, the arm 319 may define one or more flow apertures through itself to allow the fluid to flow freely when the flap is in the open position. As shown in FIGS. 12, 13 and 14, the valve and tube assembly may further include a tube cover or shell 321 spaced radially outwardly from the tube 314 to cover the tube and, if desired, support the valve and tube assembly against the box 325 (FIG. 10).

As may be recognized by those of ordinary skill in the pertinent art based on the teachings herein, the actuator 315, and the compression chamber 332 may take any of numerous different shapes and/or configurations, and/or may be formed of any of numerous different materials that are currently known, or that later become known for performing the functions of these components. For example, the compression chamber 332 may define a curvilinear shape to facilitate engagement between the underside of the dome-shaped actuator and compression chamber on the downward stroke of the actuator. Similarly, the underside of the actuator may form a more traditional piston shape, such as a cylindrical protrusion, that is slidably received within a correspondingly shaped compression chamber. In addition, the actuator may include a lever or other operator that is manually engageable to depress the actuator and, in turn, dispense metered amounts or substantially metered amounts of fluids from the variable-volume storage chamber and through the one-way valve.

Figure 15:
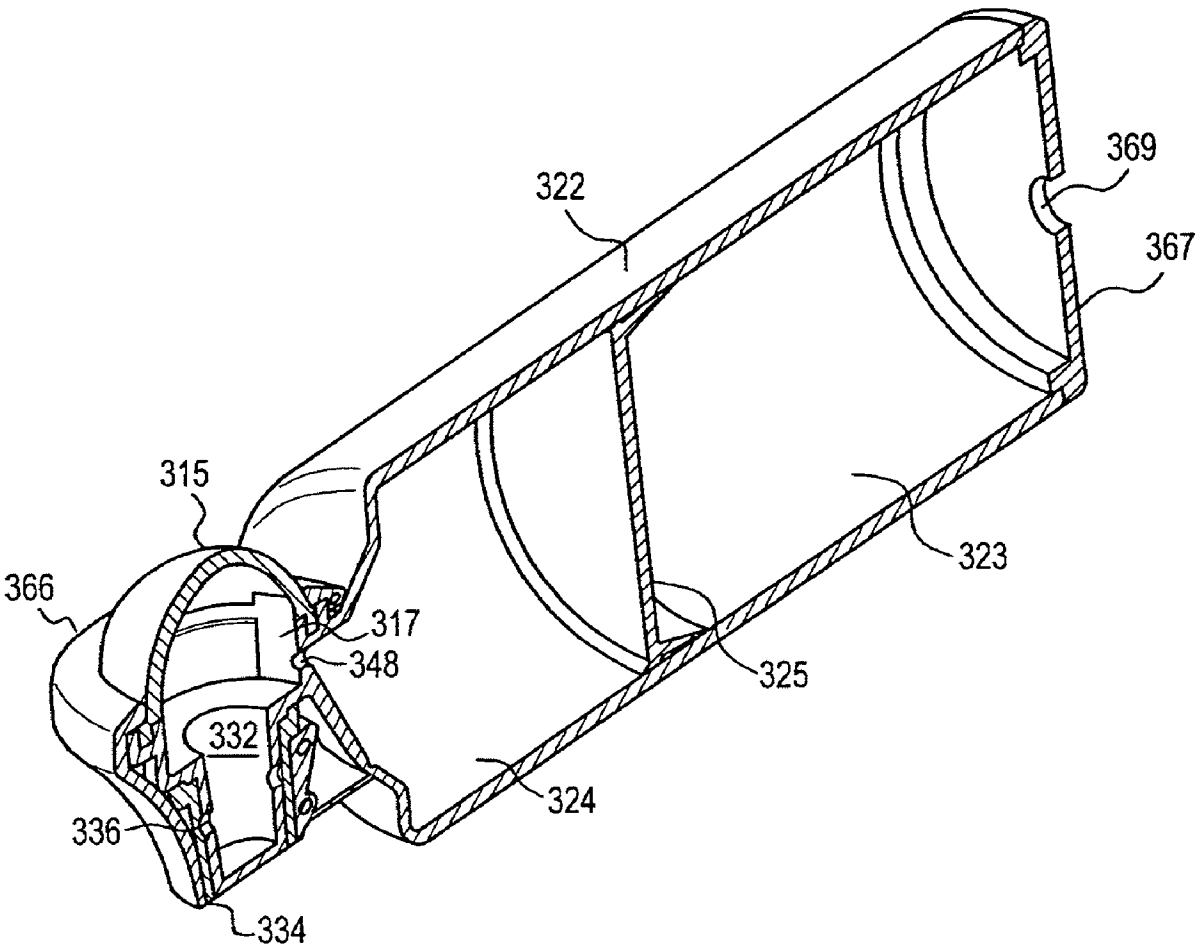
FIG. 15 is a perspective cross-sectional view of the valve assembly of FIG. 11 attached to a rigid body including a plunger slidably received therein and forming with the body a variable-volume storage chamber.

In an alternative embodiment shown in FIG. 15, the variable-volume storage chamber 324 is not defined by a flexible pouch mounted within a box as described above with reference to FIGS. 7-14, but rather is defined by a relatively rigid tubular body 322. A plunger 325 is slidably mounted within the tubular body 322 and forms a fluid-tight seal between the peripheral surface of the plunger and the internal wall of the tubular body. As can be seen, the variable-volume storage chamber 324 is formed between the plunger 325 and the inlet passageway 348 to the valve assembly 312. The tubular body 322 includes an end cap 367 defining a fluid-flow aperture 369 therein to allow air to flow freely therethrough and thereby allow the plunger 325 to slide inwardly within the tubular body 322 upon dispensing fluid from the variable-volume storage chamber 324. In this embodiment, the vacuum created within the compression chamber 332 on the upward or return stroke of the dome-shaped actuator 315 draws fluid from the variable-volume storage chamber 324 and, in turn, causes the plunger 325 to move inwardly toward the inlet passageway 348 and correspondingly adjust the volume of the storage chamber to compensate for the dispensing of fluid.

The apparatus and methods for pre-sterilizing the sealed, empty pouch, tube and valve assemblies, for assembling the stopper to the pouch or other container, and/or for aseptically needle filling the sterilized pouch, tube and valve assemblies through the needle penetrable and laser resealable stoppers, may take the form of any of the apparatus and methods disclosed in the following commonly assigned patents and patent applications which are hereby expressly incorporated by reference as part of the present disclosure: U.S. patent application Ser. No. 10/766,172, filed Jan. 28, 2004, entitled "Medicament Vial Having A Heat-Sealable Cap, And Apparatus and Method For Filling The Vial", which is a continuation-in-part of similarly titled U.S. patent application Ser. No. 10/694,364, filed Oct. 27, 2003, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; and U.S. Provisional Patent Application No. 60/443,526, filed Jan. 28, 2003; and similarly titled U.S. Provisional Patent Application No. 60/484,204, filed Jun. 30, 2003; U.S. patent application Ser. No. 10/655,455, entitled "Sealed Containers And Methods Of Making And Filling Same", filed Sep. 3, 2003, which, in turn, claims the benefit of similarly-titled U.S. Provisional Patent Application No. 60/408,068 filed Sep. 3, 2002; U.S. Provisional Patent Application No. 60/551,565, filed Mar. 8, 2004, titled "Apparatus and Method for Molding and Assembling Containers with Stoppers"; U.S. patent application Ser. No. 10/600,525 filed Jun. 19, 2003 titled "Sterile Filling Machine Having Needle Filling Station Within E-Beam Chamber", which, in turn, claims the benefit of similarly-titled U.S. Provisional Application No. 60/390,212 filed Jun. 19, 2002; U.S. patent application Ser. No. 10/983,178 filed Nov. 5, 2004 titled "Needle Filling and Laser Sealing Station", which, in turn, claims the benefit of similarly-titled U.S. Provisional Patent Application No. 60/518,267 filed Nov. 7, 2003 and similarly-titled U.S. Provisional Patent Application No. 60/518,685 filed Nov. 10, 2003; U.S. Provisional Patent Application No. 60/550,805 filed Mar. 5, 2004 titled "Apparatus for Needle Filling and Laser Resealing"; and U.S. patent application Ser. No. 08/424,932 filed Apr. 11, 1995 now U.S. Pat. No. 5,641,004 issued Jun. 24, 1997 titled "Process for Filling a Sealed Receptacle Under Aseptic Conditions".

In the currently-preferred embodiments of the present invention, each resealable stopper is formed of a thermoplastic material defining a needle penetration region that is pierceable with a needle to form a needle aperture therethrough, and is heat resealable to hermetically seal the needle aperture by applying laser radiation at a predetermined wavelength and power thereto. Each stopper includes a thermoplastic body defining (i) a predetermined wall thickness in an axial direction thereof, (ii) a predetermined color and opacity that substantially absorbs the laser radiation at the predetermined wavelength and substantially prevents the passage of the radiation through the predetermined wall thickness thereof, and (iii) a predetermined color and opacity that causes the laser radiation at the predetermined wavelength and power to hermetically seal the needle aperture formed in the needle penetration region thereof in a predetermined time period and substantially without burning the needle penetration region and/or the cover portion of the cap (i.e., without creating an irreversible change in molecular structure or chemical properties of the material). In some embodiments, the predetermined time period is approximately 2 seconds, is preferably less than or equal to about 1.5 seconds, and most preferably is less than or equal to about 1 second. In some of these embodiments, the predetermined wavelength of the laser radiation is about 980 nm, and the predetermined power of each laser is preferably less than about 30 Watts, and preferably less than or equal to about 10 Watts, or within the range of about 8 to about 10 Watts. Also in some of these embodiments, the predetermined color of the material is gray, and the predetermined opacity is defined by a dark gray colorant (or pigment) added to the stopper material in an amount within the range of about 0.3% to about 0.6% by weight.

In addition, if desired, a lubricant of a type known to those of ordinary skill in the pertinent art may be added to or included within each of the above-mentioned thermoplastic compounds, in order to prevent or otherwise reduce the formation of particles upon penetrating the needle penetration region of the thermoplastic portion with the needle. In one embodiment, the lubricant is a mineral oil that is added to the styrene block copolymer or other thermoplastic compound in an amount sufficient to prevent, or substantially prevent, the formation of particles upon penetrating same with the needle or other filling member. In another embodiment, the lubricant is a silicone, such as the liquid silicone sold by Dow Corning Corporation under the designation "360 Medical Fluid, 350 CST", or a silicone oil, that is added to the styrene block copolymer or other thermoplastic compound in an amount sufficient to prevent, or substantially prevent, the formation of particles upon penetrating same with the needle or other filling member. In one such embodiment, the silicone oil is included in an amount within the range of about 0.4% to about 1% by weight, and preferably within the range of about 0.4 to about 0.6% by weight, and most preferably within the range of about 0.51 or about 0.5% by weight.

As described above, the configuration of the needle that is penetrating the stopper, the friction forces created at the needle/stopper interface, and/or the needle stroke through the stopper also can be controlled to further reduce or substantially prevent the formation of particles upon penetrating the stoppers with the needles.

Also in accordance with a currently preferred embodiment, the needle penetrable and laser resealable stopper comprises: (i) a styrene block copolymer, such as any such styrene block copolymers described above, within the range of about 80% to about 97% by weight (e.g., 95% by weight as described above); (ii) an olefin, such as any of the ethylene alpha-olefins, polyolefins or olefins described above, within the range of about 3% to about 20% by weight (e.g., about 5% as described above); (iii) a pigment or colorant added in an amount sufficient to absorb the laser energy, convert the radiation to heat, and melt the stopper material, preferably to a depth equal to at least about ⅓ to about ½ of the depth of the needle hole, within a time period of less than about 3 seconds, more preferably less than about 1½ seconds, and most preferably less than about ½ second; and (iv) a lubricant, such as a mineral oil, liquid silicone, or silicone oil as described above, added in an amount sufficient to substantially reduce friction forces at the needle/stopper interface during needle penetration of the stopper to, in turn, substantially prevent particle formation.

In one embodiment of the invention, the pigment is sold under the brand name Lumogen™ IR 788 by BASF Aktiengesellschaft of Ludwigshafen, Germany. The Lumogen IR products are highly transparent selective near infrared absorbers designed for absorption of radiation from semiconductor lasers with wavelengths near about 800 nm. In this embodiment, the Lumogen pigment is added to the elastomeric blend in an amount sufficient to convert the radiation to heat, and melt the stopper material, preferably to a depth equal to at least about ⅓ to about ½ of the depth of the needle hole, within a time period of less than about 3 seconds, more preferably less than about 1½ seconds, and most preferably less than about ½ second. The Lumogen IR 788 pigment is highly absorbent at about 788 nm, and therefore in connection with this embodiment, the laser preferably transmits radiation at about 788 nm (or about 800 nm). One advantage of the Lumogen IR 788 pigment is that very small amounts of this pigment can be added to the elastomeric blend to achieve laser resealing within the time periods and at the resealing depths required or otherwise desired, and therefore, if desired, the needle penetrable and laser resealable stopper may be transparent or substantially transparent. This may be a significant aesthetic advantage. In one embodiment of the invention, the Lumogen IR 788 pigment is added to the elastomeric blend in a concentration of less than about 150 ppm, is preferably within the range of about 10 ppm to about 100 ppm, and most preferably is within the range of about 20 ppm to about 80 ppm. In this embodiment, the power level of the 800 nm laser is preferably less than about 30 Watts, or within the range of about 8 Watts to about 18 Watts.

Also in accordance with a currently preferred embodiment, in addition controlling one or more of the above-mentioned parameters to reduce and/or eliminate the formation of particles (i.e., including the silicone oil or other lubricant in the thermoplastic compound, and controlling the configuration of the needle, the degree of friction at the needle/stopper interface, and/or the needle stroke through the stopper), the differential elongation of the thermoplastic components of the resealable stopper is selected to reduce and/or eliminate the formation of particles.

Thus, in accordance with such embodiment, the needle penetrable and laser resealable stopper comprises: (i) a first thermoplastic material within the range of about 80% to about 97% be weight and defining a first elongation; (ii) a second thermoplastic material within the range of about 3% to about 20% by weight and defining a second elongation less than the elongation of the first material; (iii) a pigment or colorant added in an amount sufficient to absorb the laser energy, convert the radiation to heat, and melt the stopper material, preferably to a depth equal to at least about ⅓ to about ½ of the depth of the needle hole, within a time period of less than about 2 seconds, more preferably less than about 1.5 seconds, and most preferably less than about 1 second; and (iv) a lubricant, such as a mineral oil, liquid silicone, or silicone oil as described above, added in an amount sufficient to substantially reduce friction forces at the needle/stopper interface during needle penetration of the stopper to, in turn, substantially prevent particle formation.

In accordance with a further aspect, the first material defines a lower melting point (or Vicat softening temperature) than does the second material. In some of the embodiments, the first material is a styrene block copolymer, and the second material is an olefin, such as any of a variety of ethylene alpha-olefins or polyolefins. Also in accordance with a currently preferred embodiment, the first material defines an elongation of at least about 75% at 10 lbs force (i.e., the length increases by about 75% when subjected to a 10 lb. force), preferably at least about 85%, and most preferably at least about 90%; and the second material defines an elongation of at least about 5% at 10 lbs force, preferably at least about 10%, and most preferably at least about 15%, or within the range of about 15% and about 25%.

Figure 16:
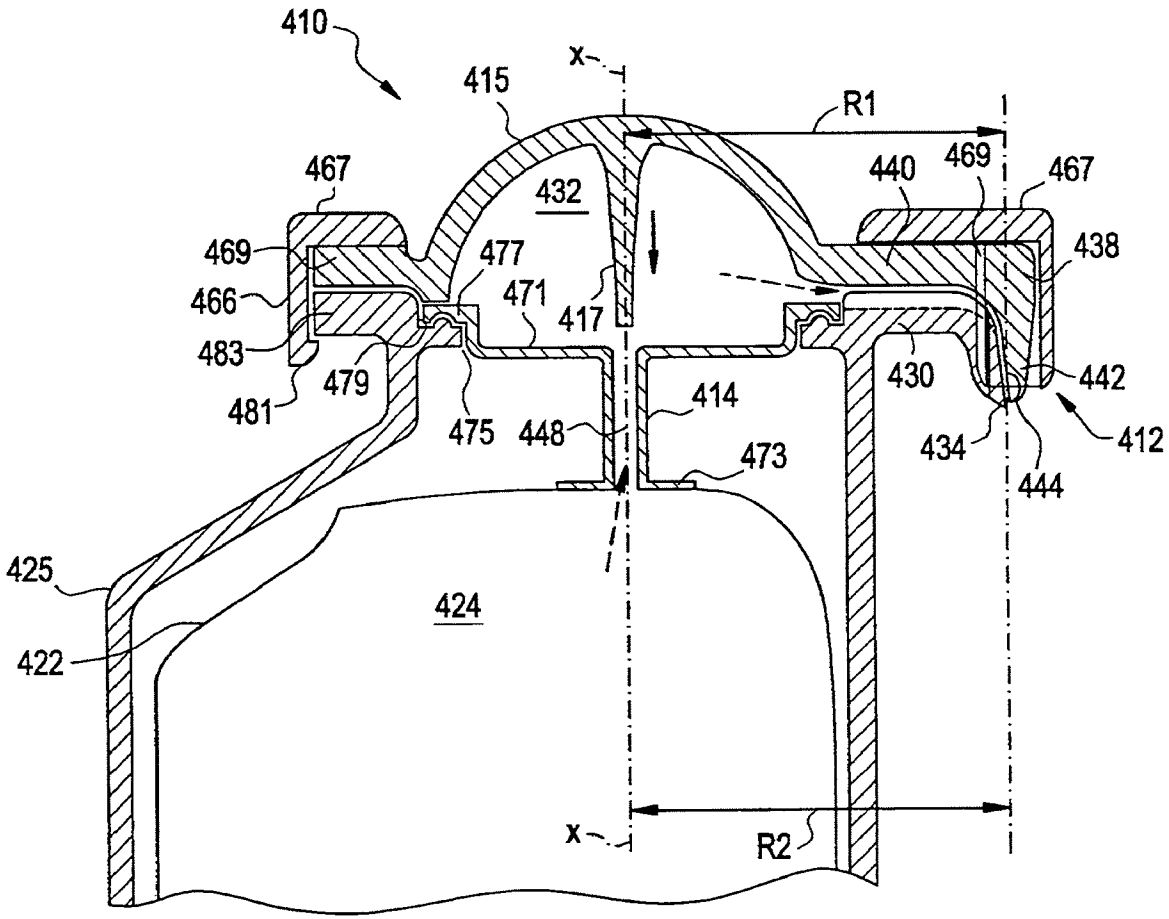
FIG. 16 is a cross-sectional view of another embodiment of a valve assembly, dome-shaped actuator, and flexible pouch coupled in fluid communication with the dome-shaped actuator and valve assembly and mounted within a relatively rigid container.
Figure 17:
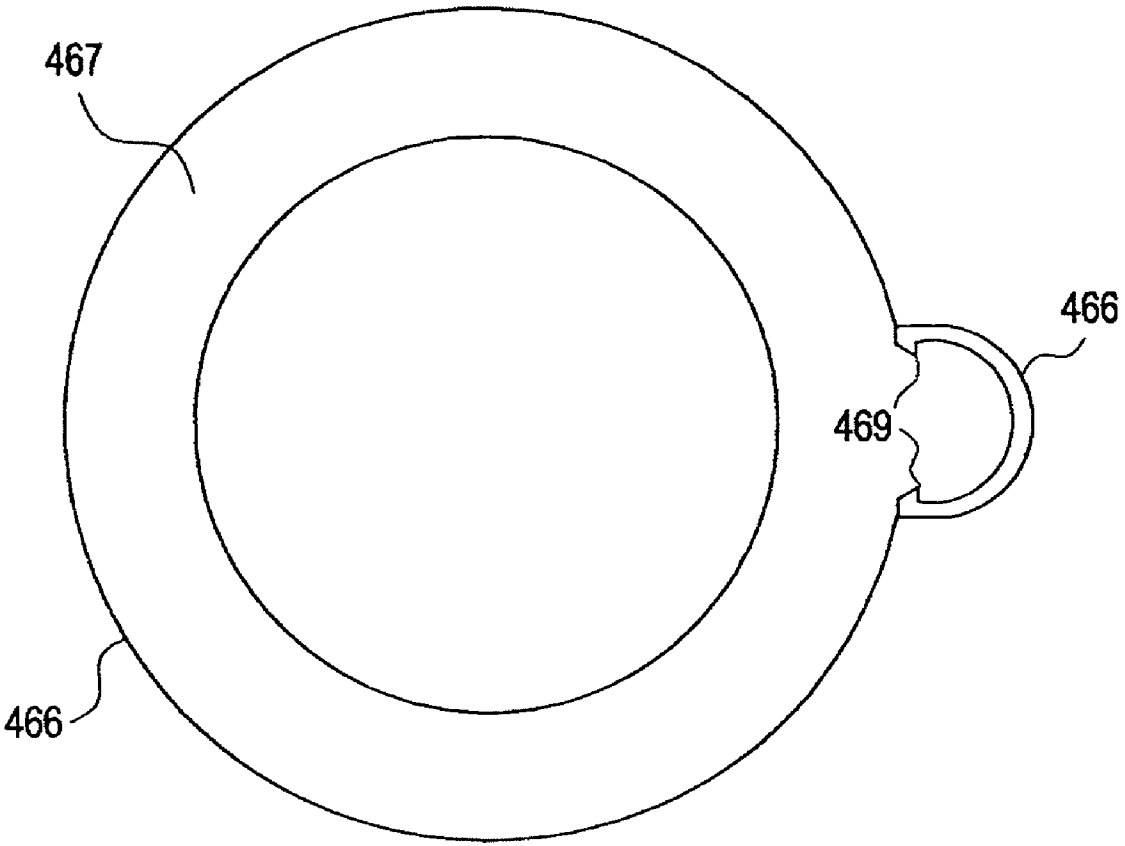
FIG. 17 is a top plan view of the snap ring of the assembly of FIG. 17 that secures the integral dome-shaped actuator and valve cover to the container.
Figure 18:
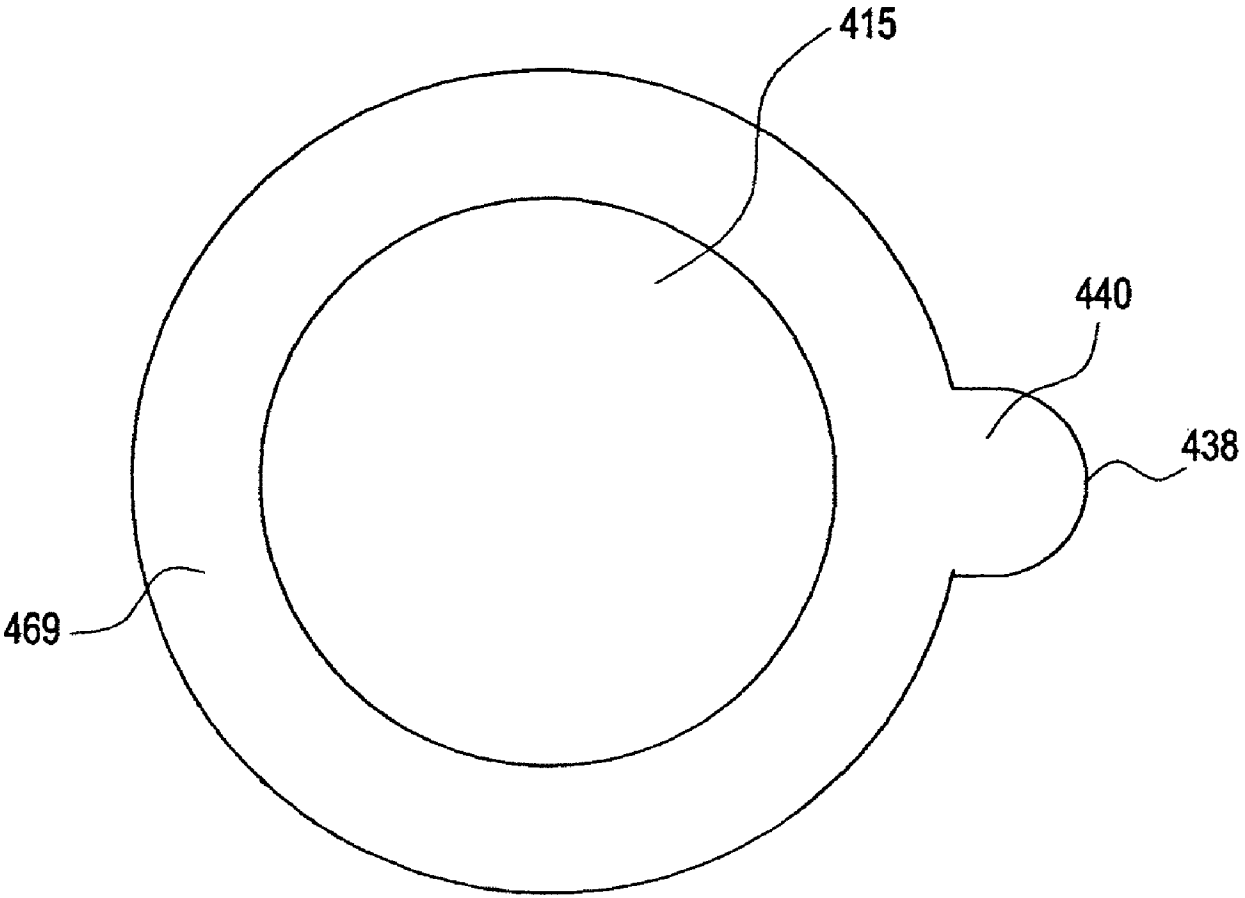
FIG. 18 is a top plan view of the integral dome-shaped actuator and valve cover of FIG. 16.

In FIGS. 16-18, another assembly embodying the present invention is indicated generally by the reference numeral 410. The assembly 410 is similar in many respects to the assemblies 210 and 310 described above with reference to FIGS. 7-15, and therefore like reference numerals preceded by the numeral "4" instead of the numerals "2" or "3" are used to indicate like elements. The variable-volume storage chamber 424 is defined by a flexible pouch 422 received within a relatively rigid box or other suitable shaped container 425. A tube 414 defining an inlet passageway 448 is coupled in fluid communication between the variable-volume storage chamber 424 and the compression chamber 432. An elastic substantially dome-shaped pump or actuator 415 defines on its inner side a compression chamber valve member 417 that forms a tapered cross-sectional configuration that tapers inwardly toward the free end of the valve member. On the downward stroke of the dome-shaped actuator 415, as indicated by the arrow in FIG. 16, the free end of the compression chamber valve member 417 is received within the inlet passageway 448 of the tube 414 to thereby prevent any additional fluid from flowing from the storage chamber 424 into the compression chamber 432 and, in turn, to sufficiently pressurize with further manual compression of the dome-shaped actuator 415 the fluid within the compression chamber 432 to overcome the valve opening pressure and to dispense a substantially predetermined amount of fluid through the one-way valve 412. On the return or upward stroke of the dome-shaped actuator 415, the free end of the valve member 417 is pulled upwardly and out of the inlet passageway 448 of the tube 414 to, in turn, place the compression chamber 432 in fluid communication with the variable-volume storage chamber 424 and thereby allow fluid to flow from the storage chamber 424 into the compression chamber 432. The pouch 422 is sufficiently flexible to decrease in internal volume in an amount that corresponds to the amount of fluid that flows from the storage chamber 424 into the compression chamber 432 on the return stroke of the dome-shaped actuator 415. Preferably, the dome-shaped actuator 415 is configured to retain sufficient spring force when depressed inwardly on the downward stroke thereof to pull itself upwardly and back into the ready position as shown typically in FIG. 16 when manually released.

The one-way valve assembly 412 includes a valve body 430 defining an axially-extending valve seat 434, and an elongated flow aperture 436 formed within the valve body 430 and extending in fluid communication between the compression chamber 432 and the valve seat 434. The one-way valve assembly 412 further includes a valve cover 438 formed of an elastic material and integral with the dome-shaped actuator 415. The valve cover 438 includes a cover base 440 mounted on the valve body 430 and fixedly secured against movement relative thereto by a flange 467 of a relatively rigid snap ring 466, and a valve portion 442 overlying the valve seat 434. As shown in FIG. 18, the valve portion 442 is arcuate shaped when viewed in a plane perpendicular to the elongated axis "X" of the assembly, and as shown typically in FIG. 16, when viewed in a plane of the elongated axis X, the valve portion 442 defines a substantially tapered cross-sectional configuration that tapers inwardly when moving in a direction from the interior toward the exterior of the valve (or from the base toward the dispensing tip of the valve). The valve portion 442 defines a predetermined radial thickness that is progressively thinner when moving in the direction from the interior toward the exterior of the valve (or from the base toward the dispensing tip of the valve). As shown in FIG. 16, the inner surface of the valve cover 442 is defined by a first varying radius R1 that progressively increases in magnitude when moving in the direction from the base toward the dispensing tip of the valve cover, and the outer surface of the valve seat 434 is defined by a second varying radius R2 that likewise progressively increases in magnitude when moving in the direction from the base toward the dispensing tip of the valve seat. Similar to the one-way valves described above, for each engaged segment of the valve cover and valve seat, R2 is greater than R1 to thereby form an interference fit between the valve cover and valve seat. Accordingly, as with the one-way valves described above, the flexible valve portion 442 and valve seat 434 cooperate to define a normally closed, axially-extending valve opening or seam 444 therebetween. Also like the one-way valves described above, the valve portion 442 is movable radially between a normally closed position, as shown in FIG. 16, with the valve portion 442 engaging the valve seat 434, and an open position (not shown) with at least a segment of the valve portion 442 spaced radially away from the valve seat 434 to connect the valve opening 444 in fluid communication with the flow aperture 436 to thereby allow the passage of fluid from the flow aperture 436 through the valve opening 444. As shown typically in FIG. 18, the valve portion 442 is substantially semi-circular when viewed in a plane perpendicular to the elongated axis X of the assembly. As indicated in FIG. 16, the valve seat 434 corresponds in shape and extent to the valve portion 442 to thereby form the normally closed, axially extending valve opening or seam 444 therebetween. As may be recognized by those of ordinary skill in the pertinent art based on the teachings herein, the shape or the valve seat and valve portion, including the arcuate extent of each such component may vary from that shown herein as desired or otherwise dictated by the application of the assembly and the desired performance characteristics. As shown in FIG. 17, the snap-ring 466 includes opposing snap flanges 469 that engage corresponding lateral portions of the valve seat 434 to fixedly secure the snap-ring to the valve seat, and in turn, fixedly retain the valve cover and valve portion therebetween.

As shown in FIG. 16, the tube 414 is formed integral on one end thereof with a base wall 471 of the compression chamber 432, and is formed integral on another end thereof with a flange 473 fixedly secured to the pouch 422. The base wall 471 of the compression chamber 432 is received within an aperture 475 of the container 425, and includes a peripheral flange 477 sealingly engaged within an annular recess 479 of the container. The snap-ring 466 defines a peripheral snap flange 481 that engages the underside of a peripheral flange 483 of the container 425 to compress the peripheral flange 469 and cover base 440 between the snap-ring and container flange at a substantially predetermined compressive preload to prevent any leakage throughout shelf-life and usage of the assembly, and thereby fixedly secure together the assembled integral dome-shaped actuator and valve cover, tube and pouch assembly, and container.

In the operation of the assembly 410, a user dispenses a substantially predetermined amount of fluid through the one-way valve 412 by manually engaging the dome-shaped actuator 415 with, for example, one or more fingers or the palm of a hand, and depresses the dome-shaped actuator downwardly. On the downward or inner stroke of the actuator, the free end of the compression chamber valve member 417 is received within the outlet aperture 448 of the tube 414 to thereby block the flow of any fluid between the compression chamber 432 and storage chamber 424. Then, as the dome-shaped actuator 415 is further depressed, the fluid within the compression chamber 432 is sufficiently pressurized to exceed the valve opening pressure of the one-way valve 412 and, in turn, open the valve and dispense substantially all of the fluid within the compression chamber through the valve. The user then removes his or her hand from the dome-shaped actuator 415, and the spring force inherent within the elastic dome-shaped actuator drives the actuator to return to its original shape or ready position as shown typically in FIG. 16. As the dome-shaped actuator 415 returns to its ready position, the free end of the compression chamber valve member 417 is removed from the inlet passageway 448 which, in turn, allows fluid to be drawn upwardly from the storage chamber into the compression chamber due to the vacuum or suction created within the compression chamber on the upward stroke of the dome-shaped actuator. When the dome-shaped actuator 415 returns to its original position, the compression chamber 432 is filled with fluid and the assembly is ready to dispense another predetermined volume of fluid. Although not shown, the box 425 may define at least one vent to allow air to flow into the space between the pouch 422 and box 425 to facilitate the ability of the pouch to fold inwardly on itself upon dispensing fluid therefrom.

As may be recognized by those of ordinary skill in the pertinent art based on the teachings herein, the pouch or dome-shaped actuator may include a needle penetrable and laser resealable stopper or other portion for needle filling the variable-volume storage chamber and laser resealing the resulting needle hole as described above. The pouch 422 and box 425 may be made of the same materials as the pouch and box described above, respectively, or may be made of any of numerous other materials that are currently known, or that later become known. For example, the box 425 may be made of plastic, such as by blow molding or thermoforming. In addition, the one-valve 412 may define a configuration that is the same as or more similar to any of the one-way valves described above in connection with the other embodiments.

Figure 19:
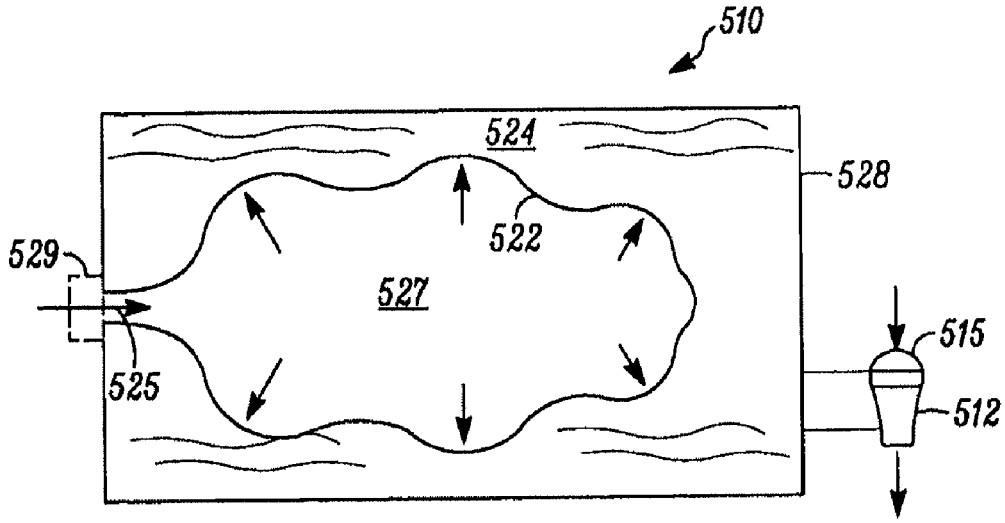
FIG. 19 is a somewhat schematic, cross-sectional view of another apparatus of the invention including an expandable bladder or pouch mounted within a relatively rigid container and defining a variable-volume storage chamber therebetween, and a pump and one-way valve assembly coupled in fluid communication with the variable-volume storage chamber for dispensing the fluid product therefrom.

In FIG. 19, another apparatus embodying the present invention is indicated generally by the reference numeral 510. The apparatus 510 is similar in many respect to various embodiments described above, and therefore like reference numerals preceded by the numeral "5", or preceded by the numeral "5" instead of another numeral, are used to indicate like elements. The primary difference of the apparatus 510 in comparison to the apparatus described above is that the apparatus 510 includes an expandable bladder or pouch 522 mounted within a relatively rigid container 528 and defining a variable-volume storage chamber 524 therebetween for storing therein the fluid to be dispensed. Preferably, the fluid is stored in the chamber 524 in a substantially airless, hermetically sealed condition throughout the shelf-life and usage of the apparatus (i.e., throughout the dispensing of multiple doses or portions of the product from the apparatus). An inlet port 525 is coupled in fluid communication between an interior chamber 527 of the expandable bladder 522 in order to allow air or other gas to flow into the interior chamber 527 to, in turn, allow the bladder 522 to expand outwardly upon dispensing fluid from the variable-volume storage chamber 524 and through the one-way valve assembly 512. In one embodiment, the expandable bladder 522 is inherently resilient and biased outwardly to expand itself outwardly upon dispensing fluid from the variable-volume storage chamber 524. In another embodiment, the apparatus includes an inlet valve 529 coupled in fluid communication between the interior chamber 527 of the pouch and the ambient atmosphere and/or a source of pressurized gas (not shown) to control the flow of air or other gas into the interior chamber 527. In one such embodiment, pressurized gas is introduced through the inlet valve 529 and into the interior chamber 527 to pressurize the expandable bladder 522 outwardly and, in turn, pressurize the fluid in the variable-volume storage chamber 524 to facilitate dispensing the fluid through the one-way valve assembly 512. In the illustrated embodiment, the apparatus includes a manually-engageable actuator 515 for pumping metered portions or doses of fluid through the valve assembly 512. However, as may be recognized by those of ordinary skill in the pertinent art based on the teachings herein, any of numerous different manually engageable, pedal actuated, electrically actuated, or electro-mechanically actuated pumps that are currently known, or that later become known, equally may be employed.

Figure 20:
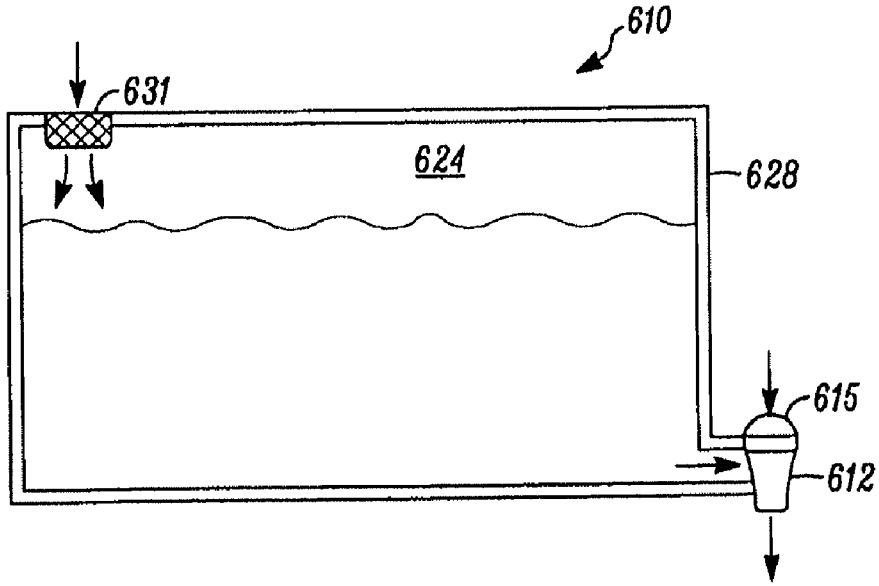
FIG. 20 is a somewhat schematic, cross-sectional view of another apparatus of the invention including a container defining a storage chamber therein, a microbial filter coupled in fluid communication between the ambient atmosphere and the storage chamber for filtering and, in turn, sterilizing the air flowing into the chamber, and a pump and one-way valve assembly coupled in fluid communication with the storage chamber for dispensing the fluid product therefrom.

In FIG. 20, another apparatus embodying the present invention is indicated generally by the reference numeral 610. The apparatus 610 is similar in many respect to various embodiments described above, and therefore like reference numerals preceded by the numeral "6", or preceded by the numeral "6" instead of another numeral, are used to indicate like elements. The primary difference of the apparatus 610 in comparison to the apparatus described above is that the apparatus 610 does not include a flexible bladder or pouch defining a variable-volume storage chamber, but rather the storage chamber 624 is defined by the interior of the container 628. A sterilizing filter 631 is mounted on the container 628 and coupled in fluid communication between the storage chamber 624 and ambient atmosphere for allowing air or other gas to flow into the storage chamber and sterilizing the air or other gas upon passage through the filter to thereby maintain the fluid product in the container in an aseptic condition. The filter 631 may take the form of any of numerous different filters that are currently known, or that later become known for performing the function of the filter 631, including a microbial filter. One such filter defines a pore size of less than about 10 microns, preferably less than about 5 microns, and most preferably less than or equal to about 2 microns. The container 628 may be rigid, semi-rigid, or flexible, and may be made of any of numerous different materials, or be formed in any of numerous different shapes or configurations, that are currently known or that later become known. In the illustrated embodiment, the apparatus includes a manually-engageable actuator 615 for pumping metered portions or doses of fluid through the valve assembly 612. However, as may be recognized by those of ordinary skill in the pertinent art based on the teachings herein, any of numerous different manually engageable, pedal actuated, electrically actuated, or electro-mechanically actuated pumps that are currently known, or that later become known, equally may be employed.

Figure 21:
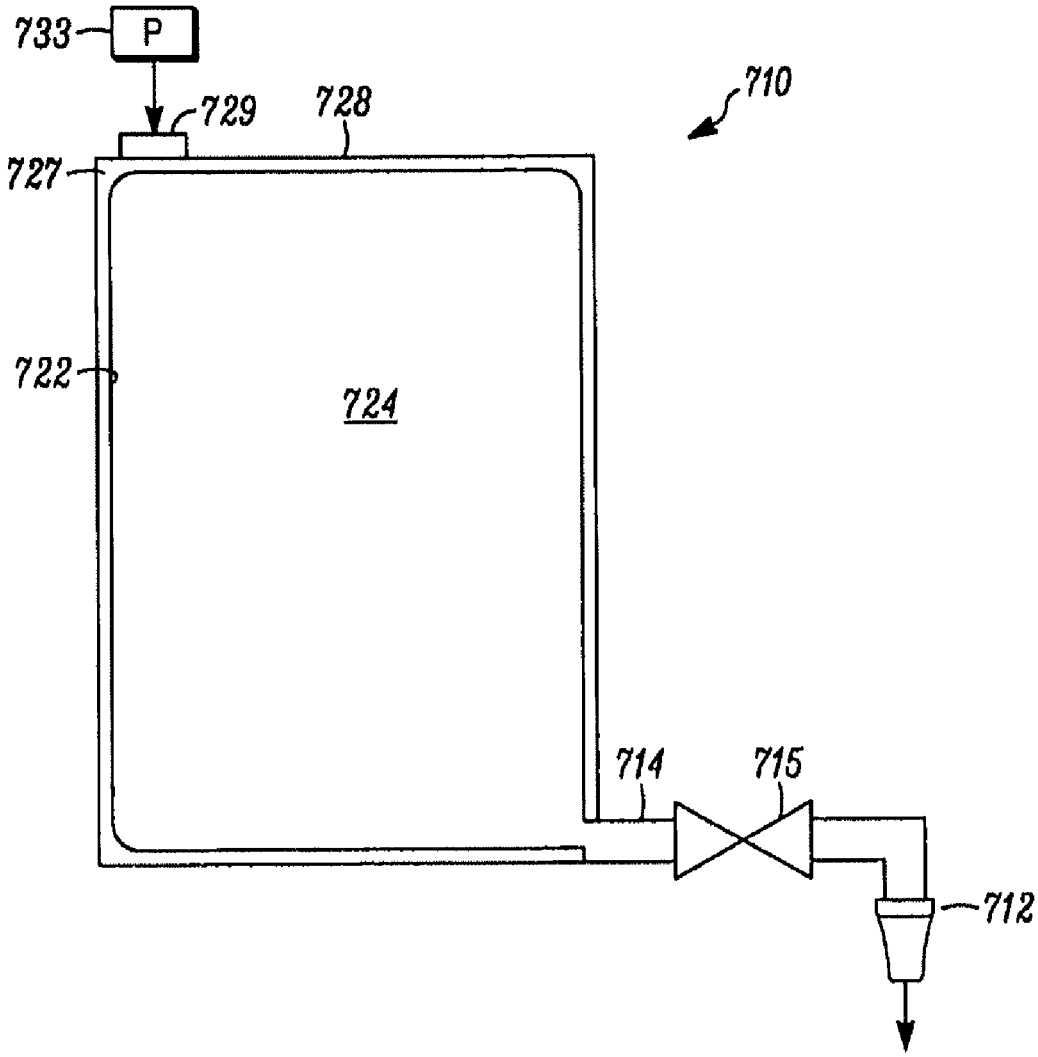
FIG. 21 is a somewhat schematic, cross-sectional view of another apparatus of the invention including a flexible pouch defining therein a variable-volume storage chamber and mounted within a relatively rigid container, a source of pressurized air or other gas coupled in fluid communication with the chamber formed between the flexible pouch and container for pressurizing the fluid product in the pouch, and a release valve and one-way valve assembly coupled in fluid communication with the variable-volume storage chamber for releasing the pressurizing fluid in the storage chamber through the one-way valve assembly.

In FIG. 21, another apparatus embodying the present invention is indicated generally by the reference numeral 710. The apparatus 710 is similar in many respect to various embodiments described above, and therefore like reference numerals preceded by the numeral "7", or preceded by the numeral "7" instead of another numeral, are used to indicate like elements. As with various embodiments described above, the apparatus 710 includes a flexible pouch 722 defining a variable-volume storage chamber 724, a one-way valve assembly 712, and a flexible tube 714 coupled in fluid communication between the one-way valve and storage chamber. An inlet valve 729 is mounted on the container 728 and is connectable in fluid communication between a source of pressurized fluid, such as air or other gas, and the interior chamber 727 formed between the flexible pouch 722 and relatively rigid container 728. In one embodiment, the pressure source 733 introduces pressurized air or other gas into the chamber 727 to, in turn, pressurize the pouch 722 and fluid product contained within the pouch. A valve 715 of a type known to those of ordinary skill in the pertinent art is movable between (i) a closed position in which it pinches the flexible tube 714 into a closed position to prevent the passage of fluid therethrough, and (ii) an open position in which it releases the flexible tube 714 and allows the passage of fluid therethrough. In the open position, the pressurized gas within the chamber 727 creates sufficient pressure to move the fluid product through the one-way valve 712. The valve 715 may be manually engageable to open and close the valve, or may be electrically or electro-mechanically actuated between the open and closed positions. In one embodiment, the container is initially filled with pressurized gas, and this amount of pressurized gas is sufficient to dispense all of the fluid product through the valve. In another embodiment, the pressure source 733 may take the form of a pump that pumps pressurized air or other gas into the chamber 727 to dispense product through the one-way valve. In this embodiment, the valve 715 may be eliminated and the pump 733 may be actuated to dispense fluid through the valve. Also in this embodiment, the pump 733 may take the form of any of numerous different manually engageable, pedal actuated, electrically actuated, or electro-mechanically actuated pumps that are currently known, or that later become known.

Figure 22:
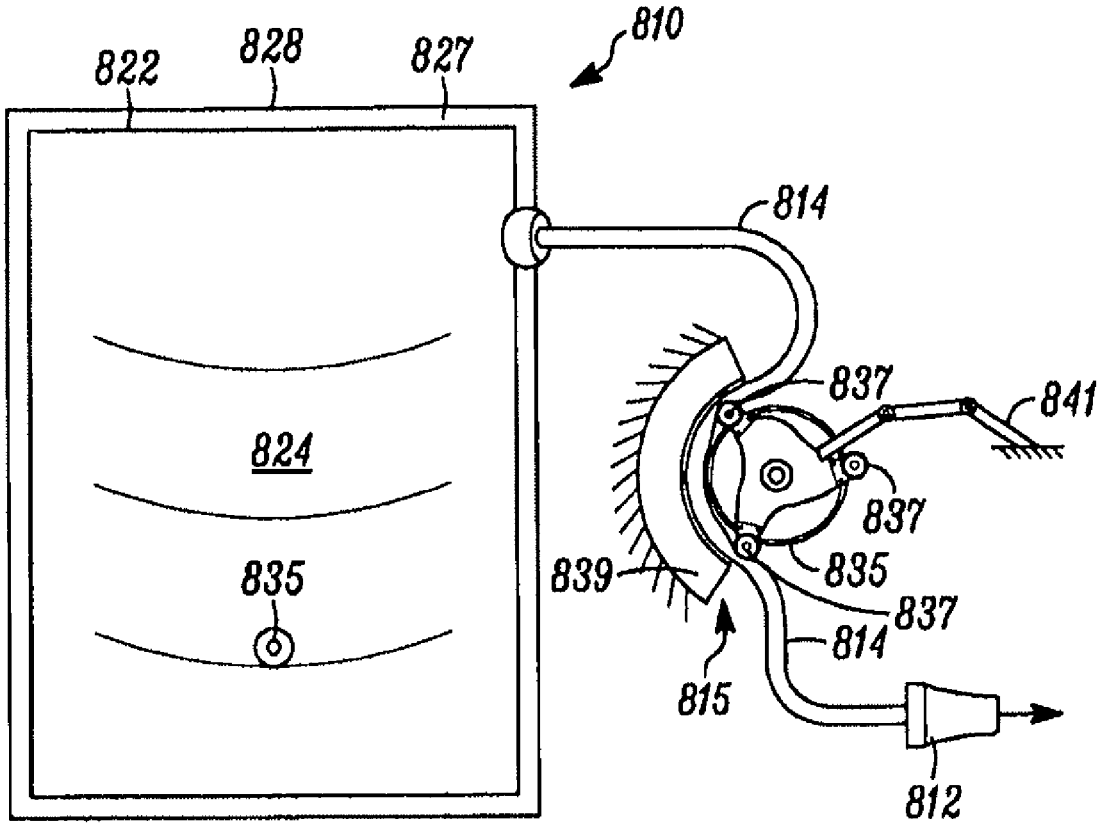
FIG. 22 is a somewhat schematic, cross-sectional view of another apparatus of the invention including a manually or pedal actuated peristaltic pump for pumping fluid product from the variable-volume storage chamber through the one-way valve.

In FIG. 22, another apparatus embodying the present invention is indicated generally by the reference numeral 810. The apparatus 810 is similar in many respect to various embodiments described above, and therefore like reference numerals preceded by the numeral "8", or preceded by the numeral "8" instead of another numeral, are used to indicate like elements. As with various embodiments described above, the apparatus 810 includes a flexible pouch 822 defining a variable-volume storage chamber 824, a one-way valve assembly 812, and a flexible tube 814 coupled in fluid communication between the one-way valve and storage chamber. The apparatus 810 comprises a manually-actuated peristaltic pump 815 mounted adjacent to and engageable with the flexible tube 814 for pumping metered portions or doses of fluid product from the variable-volume storage chamber 824 through the tube 814 and one-way valve assembly 812. In the illustrated embodiment, the pump 815 is manually or pedal actuated, and comprises a rotatably mounted peristaltic pumping member 835 including a plurality of rollers 837 mounted about the periphery thereof for rotatably engaging the flexible tube 814 and squeezing the tube to in turn pump the fluid product therethrough. A curvilinear shaped, rigid pump block 839 is mounted on the opposite side of the flexible tube 814 relative to the peristaltic pumping member 835 to allow the rollers 837 to compress the flexible tube 814 against the block and pump the fluid product therethrough. A linkage assembly 841, such as the illustrated multi-bar linkage, is drivingly connected to the peristaltic pumping member 835 to rotatably drive the pumping member. A manually engageable lever or foot pedal (not shown) is drivingly connected to the linkage 841 to drive the linkage and, in turn, rotatably drive the peristaltic pumping member 835 to pump metered portions of fluid product from the variable-volume storage chamber 824 through the one-way valve assembly 812. The flexible pouch, tube and valve assemblies are provided in a disposable form so that they are disposed of when emptied; however, the container 810 and pump 815 normally do not touch the fluid product and therefore may be reused with numerous different pouch, tube and valve assemblies, or likewise may be provided in disposable form.

Figure 23:
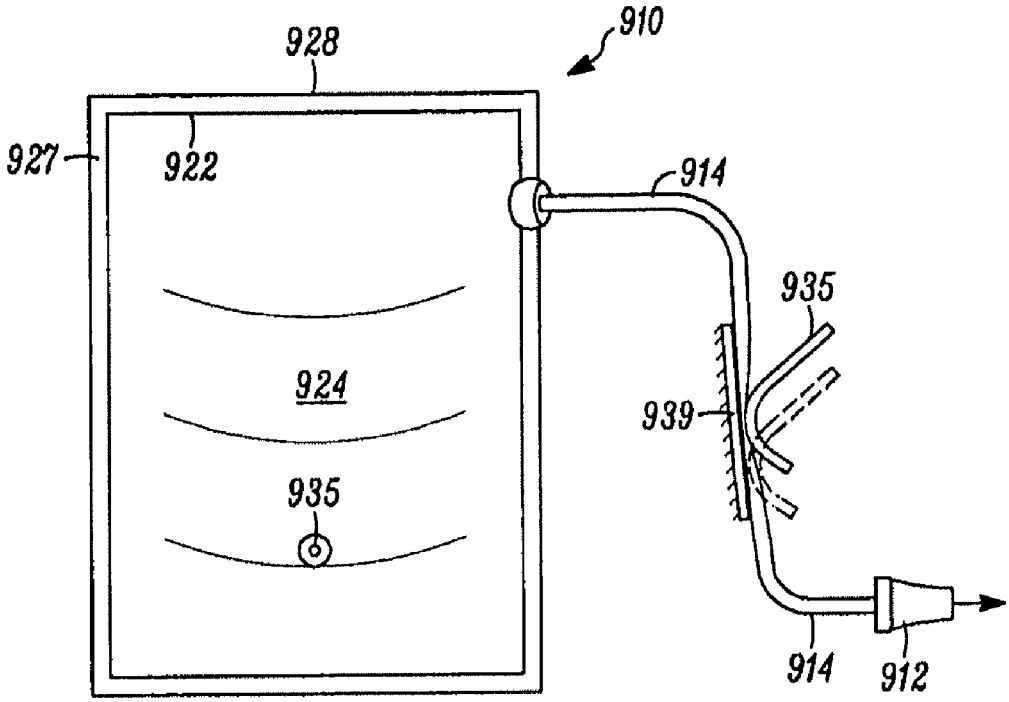
FIG. 23 is a somewhat schematic, cross-sectional view of another apparatus of the invention including a manually actuated rocker arm pump for pumping fluid product from the variable-volume storage chamber through the one-way valve.

In FIG. 23, another apparatus embodying the present invention is indicated generally by the reference numeral 910. The apparatus 910 is similar in many respect to various embodiments described above, and therefore like reference numerals preceded by the numeral "9", or preceded by the numeral "9" instead of another numeral, are used to indicate like elements. As with various embodiments described above, the apparatus 910 includes a flexible pouch 922 defining a variable-volume storage chamber 924, a one-way valve assembly 912, and a flexible tube 914 coupled in fluid communication between the one-way valve and storage chamber. In the illustrated embodiment, the pump 915 is manually or pedal actuated, and comprises pump block 939 mounted on one side of the flexible tube 914, and a rocker arm 935 pivotally mounted on the opposite side of the flexible tube. As indicated by the arrow and broken lines in the drawing, the rocker arm is manually actuated downwardly in the drawing to engage the flexible tube 914 and, in turn, squeeze the tube to pump metered portions or doses of fluid product therethrough. The rocker arm 935 may be manually engageable itself, or a manually engageable lever or other actuator may be coupled to the rocker to move the rocker arm in the manner indicated and, in turn, pump metered portions of fluid product through the one-way valve. The flexible pouch, tube and valve assemblies are provided in a disposable form so that they are disposed of when emptied; however, the container 810 and pump 815 normally do not touch the fluid product and therefore may be reused with numerous different pouch, tube and valve assemblies, or likewise may be provided in disposable form.

One advantage of the present invention is that the same product may remain shelf-stable in the pouch, whether refrigerated or not, throughout the shelf life and usage of the pouch. Accordingly, the present invention is particularly suitable for storing and dispensing ready-to-drink products, including non-acid products, such as those that are generally difficult to preserve upon opening of the package, including without limitation, drinks such as wine, milk-containing drinks, cocoa-based drinks, malt based drinks, tea, coffee, coffee concentrate, tea concentrate, other concentrates for making beverage or food products, sauces, such as cheese and milk, or meat-based sauces, gravies, soups, and nutritional drink supplements, meal replacements, baby formulas, milks, growing-up milks, etc. Accordingly, a significant advantage of the currently preferred embodiments of the present invention is that they allow the above-mentioned and any of numerous other products to be distributed and stored at an ambient temperature and allow the product to remain shelf-stable even after dispensing product from the pouch, whether refrigerated or not. However, for certain products it may be desirable to refrigerate the product to provide a better taste, to provide the product at a desired or customary temperature, or for any of numerous reasons that are currently known or that later become known.

This patent application contains subject matter related to that disclosed in U.S. patent application Ser. No. 11/295,274, filed Dec. 5, 2005, entitled "One-Way Valve And Apparatus Using The Valve", U.S. patent application Ser. No. 11/295,251, filed Dec. 5, 2005, entitled "Method Of Using One-Way Valve And Related Apparatus", U.S. Provisional Patent Application Ser. No. 60/633,332, filed Dec. 4, 2004, U.S. Provisional Patent Application Ser. No. 60/644,130, filed Jan. 14, 2005, both of which are entitled "One-Way Valve, Apparatus and Method of Using the Valve", U.S. Provisional Patent Application Ser. No. 60/757,161, filed Jan. 5, 2006, and U.S. Provisional Patent Application Ser. No. 60/843,131, filed Sep. 9, 2006, both of which are entitled "One-Way Valve and Apparatus and Method of Using the Valve". Each of the foregoing patent applications is hereby incorporated by reference in its entirety as part of the present disclosure.

As may be recognized by those of ordinary skill in the pertinent art based on the teachings herein, numerous changes and modifications may be made to the above-described and other embodiments of the present invention without departing from the spirit of the invention as defined in the claims. For example, the components of the apparatus may be made of any of numerous different materials that are currently known, or that later become known for performing the function(s) of each such component. Similarly, the components of the apparatus may take any of numerous different shapes and/or configurations, additional components may be added, components may be combined, and one or more components or features may be removed.

In addition, the apparatus may be used to dispense any of numerous different types of fluids or other substances for any of numerous different applications, including, for example, nutritional, food, beverage, hospital, biopharmaceutical, bioprocessing and pharmaceutical applications. For example, the dispenser may take the form of an automated food or beverage dispenser of the type disclosed in U.S. patent application Ser. No. 10/328,826, filed Dec. 24, 2002, entitled "Clean-In-Place Automated Food Or Beverage Dispenser" (Publication No. US 2004/0118291 A1), or U.S. patent application Ser. No. 10/833,110, filed Apr. 28, 2004, entitled "Clean-In-Place Automated Food Or Beverage Dispenser" (Publication No. US 2004/0194811 A1), each of which is hereby expressly incorporated by reference as part of the present disclosure. In this exemplary application, the tube and one-way valve assembly disclosed herein replaces the tube and pinch valve coupled between the reservoir and manifold. Alternatively, the one-way valve, tube and pouch assemblies disclosed herein replace each tube and pinch valve and associated reservoir disclosed in such patent applications. A significant advantage of this application is that the one-way valve substantially prevents any micro-organisms from entering into the reservoir that may contain a milk-based product, and further, permits the milk-based product to be dispensed at ambient temperature without requiring refrigeration of the container. In addition, the one-way valve, tube and pouch assemblies may be used to store any of numerous different products for dispensing, such as milk-based products, including milk concentrate, half-and-half, and other creamers, baby food or formulas, growing-up milks, other liquid nutrition products, coffee, coffee concentrate, tea, tea concentrate, syrup, such as chocolate syrup for hot chocolate, cappuccino syrups, or other drink mixes or syrups, coffee aroma for dispensing a "fresh" coffee aroma at the time of, or substantially the same time of dispensing coffee, or other dairy products such as yogurt and ice cream, or non-dairy products, such as juices, soy-based products, nutritional supplement drinks, functional food products, drink mixes, or meal replacement drinks.

Further, the filling machines used to fill the reservoirs used with the apparatus of the present invention may take any of numerous different configurations that are currently known, or that later become known for filling the reservoirs, pouches or dispensers. For example, the filling machines may have any of numerous different mechanisms for sterilizing, feeding, evacuating and/or filling the one-way valve, tube and pouch assemblies, or otherwise for filling the reservoirs. In addition, rather than use the needle penetrable and resealable stopper, the reservoir may employ a filling valve as disclosed in the following patent application that is assigned to the Assignee of the present invention, and is hereby incorporated by reference as part of the present disclosure: U.S. application Ser. No. 10/843,902, filed May 12, 2004, titled "Dispenser and Apparatus and Method for Filling a Dispenser". In such alternative embodiments, the filling valve may extend through the pouch or otherwise may be coupled in fluid communication with the storage chamber to evacuate and/or fill the storage chamber. Alternatively, the reservoir may include a one-way valve for evacuating the interior of the reservoir and another valve for filling the storage chamber of the reservoir. In addition, any of numerous different types of pouch filling machines and/or methods that are currently known, or that later become known, may be used instead. Still further, the pump and/or dispensing valve each may take a configuration that is different than that disclosed herein. For example, the pump may take the form of any of numerous different pumps that are currently known, or that later become known. For example, the pump may include a piston that is movable within a piston chamber connectable in fluid communication with the tube and/or variable-volume storage chamber, and a manually engageable portion that is manually engageable to move the piston and, in turn, pump the substance from the variable volume storage chamber through the one-way valve. Alternatively, instead of a dome-shaped member, the pump may define an elastic squeeze bulb that is manually squeezed to dispense a substantially metered volume of fluid from the variable-volume storage chamber and through the one-way valve, or may define a different type of manually engageable actuator and a different type of spring, such as a coil spring, or an elastic spring, that creates sufficient spring force on a downward stroke of the manually engageable actuator to return the actuator to its ready position when released by the user. Alternatively, the pump may include a lever coupled to a piston or to a dome-shaped member for dispensing fluids through the valve, or may include another type of manually engageable member or pedal that is currently known, or that later becomes known. Accordingly, this detailed description of currently preferred embodiments is to be taken in an illustrative, as opposed to a limiting sense.

What is claimed is:

1. A flexible pouch and valve assembly for aseptically storing a substance, dispensing multiple portions of stored substance therefrom, and maintaining substance remaining in the pouch in an aseptic condition sealed with respect to ambient atmosphere, wherein the flexible pouch and valve assembly are receivable within a relatively rigid housing and adapted to cooperate with a pump for pumping discrete portions of the substance from the pouch and through a one-way valve to dispense the substance therefrom, the assembly comprising:

the flexible pouch defining therein a variable-volume storage chamber sealed with respect to the ambient atmosphere for aseptically storing therein multiple portions of the substance; and a one-way valve connectible in fluid communication with the substance from the variable-volume storage chamber and including a valve seat and a valve portion overlying the valve seat, wherein the valve portion defines a dimension that is less than a dimension of the valve seat to form an interference fit with the valve seat in at least one location where the valve portion overlies the valve seat, the valve portion and the valve seat define a normally closed valve opening therebetween, and the valve portion is movable between (i) a normally closed position with the valve portion engaging the valve seat, and (ii) an open position with at least a segment of the valve portion spaced away from the valve seat to allow passage of substance from the variable-volume storage chamber through the valve opening, wherein in the normally closed and open positions the one-way valve maintains the substance remaining in the variable-volume storage chamber in an aseptic condition and sealed with respect to the ambient atmosphere.

2. An assembly as defined in claim 1, wherein the flexible pouch defines a sealed, empty, aseptic storage chamber adapted to receive therein a substance to be stored and dispensed therefrom.

3. An assembly as defined in claim 1, wherein the flexible pouch is aseptically filled with a substance that is at least one of a vaccine, medicine, pharmaceutical product, food and beverage.

4. An assembly as defined in claim 3, wherein the substance is selected from the group including a milk-based product, a non-acid product, a water-based product, milk, evaporated milk, condensed milk, cream, half-and-half, baby formula, growing up milk, yogurt, soup, ice cream, juice, syrup, coffee, condiments, ketchup, mustard, mayonnaise, and coffee aroma.

5. An assembly as defined in claim 1, further comprising a flexible tube coupled in fluid communication between the pouch and one-way valve.

6. An assembly as defined in claim 5, wherein the flexible tube is connected to the flexible pouch and one-way valve by at least one of (i) a fitting mounted on at least one of the flexible pouch and one-way valve that frictionally engages a respective end of the tube to form a hermetic seal therebetween, (ii) a heat seal, (iii) a weld, and (iv) an adhesive.

7. An assembly as defined in claim 1, wherein the pouch is formed of a plastic laminate including an oxygen/water barrier and an approved food contact layer.

8. An assembly as defined in claim 1, in combination with a dispenser comprising a relatively rigid container receiving therein the flexible pouch, and a surface for supporting and positioning the one-way valve for dispensing substances therefrom and into another container.

9. An assembly and dispenser as defined in claim 8, wherein the dispenser further includes a pump operatively coupled between the variable-volume storage chamber and the one-way valve, and a control unit electrically coupled to the pump to control operation of the pump and, in turn, control dispensing of substance within the variable-volume storage chamber, through the one-way valve, and into the other container.

10. An assembly and dispenser as defined in claim 9, wherein the dispenser includes at least one pouch, and the at least one pouch includes at least one of coffee, coffee concentrate, milk, milk-based product, half-and-half, and creamer.

11. An assembly and dispenser as defined in claim 10, wherein the dispenser includes at least one additional pouch containing coffee aroma.

12. An assembly as defined in claim 1, further including a pump comprising an elastic actuator coupled in fluid communication between the pouch and one-way valve and manually movable to pump substance from the variable-volume storage chamber through the one-way valve.

13. An assembly as defined in claim 12, wherein the elastic actuator is approximately dome-shaped.

14. An assembly as defined in claim 13, further comprising a manually-engageable operator that is manually engageable to depress the elastic actuator and, in turn, dispense substance from the variable-volume storage chamber through the one-way valve.

15. An assembly as defined in claim 14, wherein the manually-engageable operator is a lever.

16. An assembly as defined in claim 14, further comprising a relatively rigid container receiving therein the flexible pouch.

17. An assembly as defined in claim 16, wherein the relatively rigid container is made of either cardboard or plastic.

18. An assembly as defined in claim 1, wherein at least one of (i) the valve portion and valve seat define a decreasing degree of interference therebetween in a direction from an upstream end toward a downstream end of the valve opening, (ii) the valve portion defines a decreasing radial thickness when moving in a direction from an upstream end toward a downstream end of the valve opening, and (iii) the valve portion and valve seat define a configuration such that the energy required to open respective segments in the valve portion progressively decreases in a direction from an upstream end toward a downstream end of the valve opening.

19. An assembly as defined in claim 1, further comprising a penetrable and resealable portion, wherein the penetrable and resealable portion is (i) penetrable with a filling or injection member for introducing the substance therethrough and into the variable volume storage chamber, and (ii) resealable, such that after applying radiation or energy to a resultant penetrated region of the penetrable and resealable portion, the substance in the variable-volume storage chamber is sealed with respect to the ambient atmosphere.

20. An assembly as defined in claim 19, wherein the penetrable and resealable portion is thermally resealable by applying at least one of laser radiation and thermal energy thereto.

21. A method for storing substance and dispensing multiple portions of stored substance, comprising the following steps:

(1) providing an assembly comprising a storage chamber and a one-way valve connectible in fluid communication with substance from the storage chamber and including a valve seat and a valve portion overlying the valve seat, wherein the valve portion defines a dimension that is less than a dimension of the valve seat to form an interference fit with the valve seat in at least one location where the valve portion overlies the valve seat, the valve portion and the valve seat define a normally closed valve opening therebetween, and the valve portion is movable relative to the valve seat between a normally closed position with the valve portion engaging the valve seat, and an open position with at least a segment of the valve portion spaced away from the valve seat to allow passage of substance from the storage chamber through the valve opening;

(2) storing multiple portions of substance in the storage chamber in an aseptic condition; and (3) maintaining the substance in the storage chamber in an aseptic condition during the shelf life and dispensing of the substance through the one-way valve.

22. A method as defined in claim 21, wherein the storage chamber comprises a hermetically sealed variable volume-storage chamber;

the storing step further comprises storing the substance in the variable storage chamber at least one of (i) in a substantially airless condition, (ii) preservative-free, and (iii) at ambient temperature; and the maintaining step further comprises maintaining the substance in the variable-volume storage chamber at least one of (i) in a substantially airless condition, (ii) preservative-free, and (iii) at ambient temperature during the shelf life and dispensing of the substance through the one-way valve.

23. A method as defined in claim 21, wherein at least one of (i) the valve portion and valve seat define a decreasing degree of interference therebetween in a direction from an upstream end toward a downstream end of the valve opening, (ii) the valve portion defines a decreasing radial thickness when moving in a direction from an upstream end toward a downstream end of the valve opening, and (iii) the valve portion and valve seat define a configuration such that the energy required to open respective segments in the valve portion progressively decreases in a direction from an upstream end toward a downstream end of the valve opening.

24. A method as defined in claim 21, further comprising the step of aseptically filling the storage chamber with substance comprising at least one of a vaccine, a medicine, a pharmaceutical product, a food and a beverage.

25. A method as defined in claim 24, wherein the filling step comprises filling the storage chamber with at least one of a milk-based product, a baby formula, a non-acid product, and a water-based product.

26. A method as defined in claim 24, wherein the assembly further comprises a penetrable and resealable portion; and the step of aseptically filling the storage chamber comprises:

penetrating the penetrable and resealable portion with a filling or injection member;

introducing the substance through the filling or injection member and into the storage chamber;

withdrawing the filling or injection member from the penetrable and resealable portion;

applying radiation or energy to a resultant penetrated region of the penetrable and resealable portion; and hermetically resealing the penetrable and resealable portion.

27. A method as defined in claim 26, wherein the step of applying radiation or energy comprises applying either thermal energy or laser radiation and thereby thermally resealing the penetrable and resealable portion.

* * * * *